United States Patent [19]
Eaton
[11] 4,318,289
[45] Mar. 9, 1982

[54] PIPE CUTTING METHOD AND APPARATUS

[75] Inventor: Homer L. Eaton, Leucadia, Calif.
[73] Assignee: Eaton Leonard Corporation, Carlsbad, Calif.

[21] Appl. No.: 110,677
[22] Filed: Jan. 9, 1980

Related U.S. Application Data

[62] Division of Ser. No. 885,329, Mar. 10, 1978, Pat. No. 4,232,813.

[51] Int. Cl.[3] ..... B21D 7/04
[52] U.S. Cl. ..... 72/131; 72/154; 72/155
[58] Field of Search ..... 72/7, 129, 131, 132, 72/149, 154–156, 159, 294; 83/54, 319, 382, 456, 459, 460

[56] References Cited

U.S. PATENT DOCUMENTS

| | | | |
|---|---|---|---|
| Re. 27,021 | 1/1971 | Ott | 72/7 X |
| 1,598,294 | 8/1926 | Lundvall | 72/131 |
| 1,675,299 | 6/1928 | Dawson | 72/129 |
| 3,145,462 | 8/1964 | Bognar | 83/319 X |
| 3,288,011 | 11/1966 | Borzym | 83/319 X |
| 3,762,196 | 10/1973 | Kempken | 72/294 X |
| 4,063,441 | 12/1977 | Eaton | 72/154 X |
| 4,132,106 | 1/1979 | Bihler | 72/149 X |

FOREIGN PATENT DOCUMENTS

| | | | |
|---|---|---|---|
| 2202253 | 8/1973 | Fed. Rep. of Germany | 72/129 |

*Primary Examiner*—Ervin M. Combs
*Attorney, Agent, or Firm*—Gausewitz, Carr, Rothenberg & Edwards

[57] ABSTRACT

Material is drawn from a roll of flat stock, passed through a pipe forming machine, and welded to provide a continuous length of pipe which is stored in a variable size loop. Pipe is withdrawn from the loop by means of a series of pipe straightening and feeding rollers which feeds the pipe to a bending machine. The bending machine is suspended from an overhead platform for rotation about a vertical axis and carries a shearing cutter so that multi-bend pipe sections, such as automobile exhaust pipes, may be bent, severed and dropped onto a conveyor for inspection and disposition while the pipe is being continuously formed from the flat stock. Distance between bends and plane of bend are respectively controlled by the pipe feeder and the bend machine rotation. Differences between forming and bending rates are compensated by varying the amount of pipe in the storage loop.

12 Claims, 23 Drawing Figures

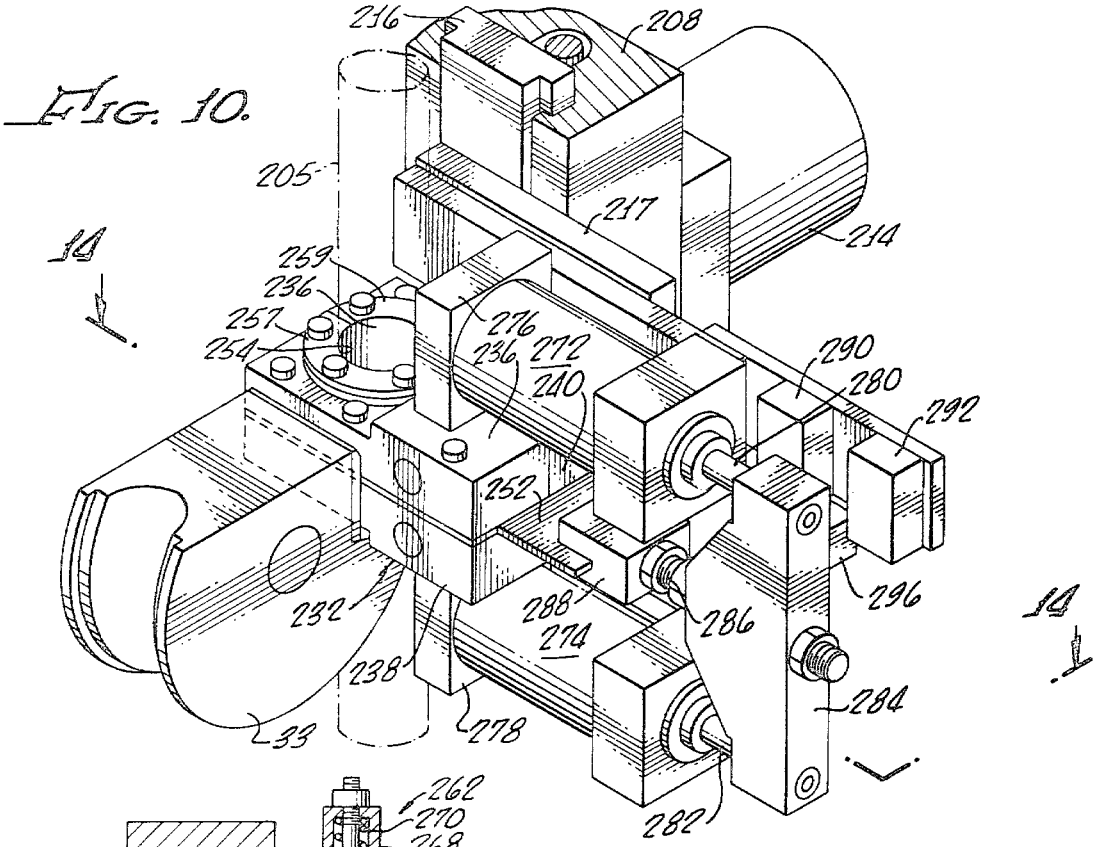
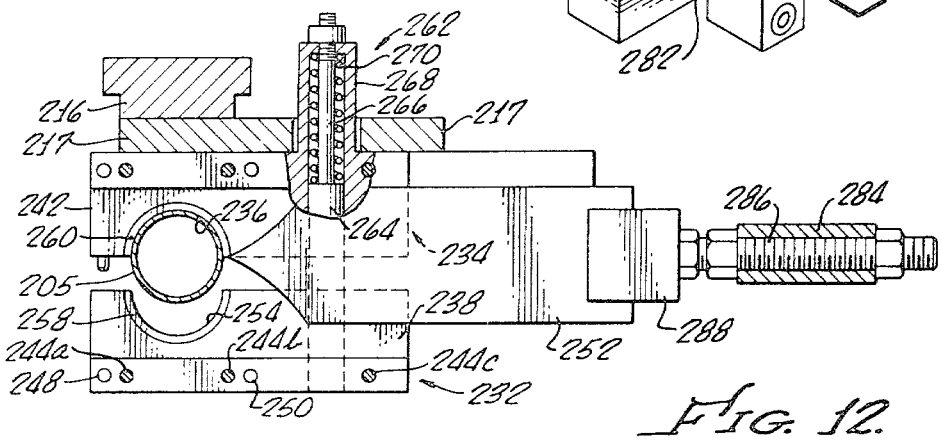
FIG. 12.
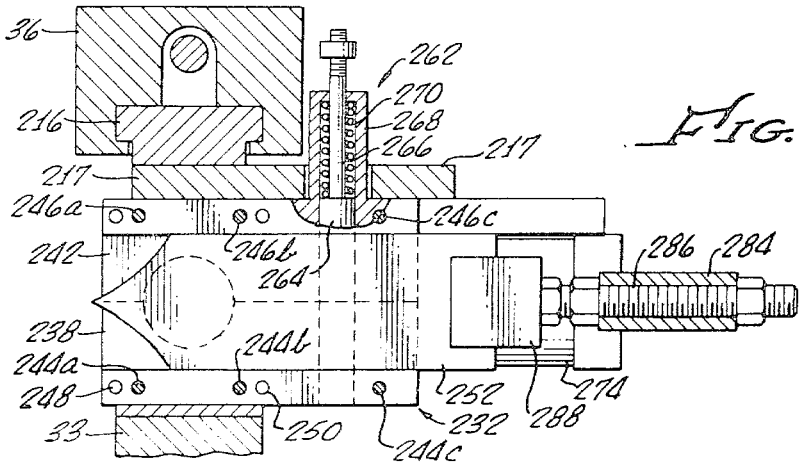
FIG. 14.

PIPE CUTTING METHOD AND APPARATUS

This is a division of application Ser. No. 885,329, filed Mar. 10, 1978, now U.S. Pat. No. 4,232,813.

BACKGROUND OF THE INVENTION

The present invention relates to methods and apparatus for bending pipe and more particularly concerns bending of pipe as the pipe itself is being formed or withdrawn from a substantially continuous supply.

Sections of tubing or pipe having one or more bends formed therein, are widely used for a variety of applications of which an important application is use as automobile engine exhaust system pipe. At present, in the manufacture of automobile exhaust pipes, straight pipe sections of predetermined lengths are bent in manual or automatic bending machines, such as machines described in U.S. Pat. No. 3,974,676 for Tube Bending Machine and Carriage Therefor and U.S. Pat. No. 3,949,582 for Positioning Servo and Controlled Mechanism. Even where a semi-automatic loader is employed to load the pipe on the machine, the pipe sections are of pre-selected length and are removed by hand from a stack of such lengths. Welded pipe must be oriented by hand so that its seam has a predetermined orientation. This is required to ensure repeatability of bend dimensions, since position of the weld seam has a significant effect upon bend parameters.

Upon each loading of a pipe section in the machine, an end of the pipe is grasped by a collet. If the end is deformed in any manner, as from prior handling or the like, difficulties and time-consuming efforts are encountered in grasping of the pipe end by the collet. These aspects of pipe bending, among others, require the operator to be located close to the machine, which increases risks to personal safety.

Pipe sections are stored in pallets, hoppers, and racks, and forklifts and operators are now required for access to such storage. In addition, large areas of manufacturing facilities, sometimes in the order of three-quarters of total plant area, are employed for material storage in some operations.

Generally pipe is formed in separate facilities embodying large and expensive installations and requiring several people for operation. These are often set up to efficiently make a relatively long run of pipe of a single diameter and gage before a different pipe may be made. Change over for manufacture of pipe of a different diameter may take several hours.

The manufactured pipe is cut and often re-cut, then stored either at the pipe forming facility or at the pipe bending facility, or at both facilities, for two to three weeks or even longer periods. Stored pipe is coated with a protective coating such as oil or the like and, during storage, this coating will evaporate to an extent that depends upon the length of storage time and the environment of the storage area. This variable evaporation gives rise to significant bending errors since pipes with less oil coating will draw more, wrinkle less and have less springback than pipes with more oil coating. In other words, the precision or the actual dimensions of bend parameters of the pipe depend to a significant extent upon the length of time the pipe has been stored and the place in which it has been stored. Exactly the same bending techniques applied to two different pipe sections that have been stored for different times or in different places may result in different bend parameters of the finished bend pipe even though such two pipe sections were derived from the same run of formed pipe.

Thus it will be seen that a considerable amount of wasted effort, facilities, time and personnel, are involved in the system followed by most bent pipe manufacturers and further, the system has many disadvantages and inherent errors that significantly diminish precision and tolerance of bend parameters.

Accordingly, it is an object of the present invention to provide methods and apparatus for manufacturing bent pipe which avoid or minimize above-mentioned problems.

SUMMARY OF THE INVENTION

In carrying out principles of the present invention in accordance with a preferred embodiment thereof, a length of pipe is provided at a supply station from which it is withdrawn for bending, a forward portion of the length of pipe is bent at a bending station remote from the supply station, an intermediate portion of the pipe is stored between the stations, and the amount of stored pipe is varied in accordance with the rate of withdrawal and the rate of bending. The supply station may be either a long length of previously formed pipe or a tube mill that forms pipe as it is bent at the bending station.

According to a feature of the invention, the intermediate pipe portion is stored in a loop of which the size is sensed to control at least one of the operations so as to decrease the difference between the rate at which pipe leaves the supply station and the rate of the bending operation. The arrangement maintains a predetermined orientation of the weld seam of the pipe and employs a pipe feeding means to control distance between bends.

According to another feature of the invention, plane of bend is controlled by rotating the entire bend head relative to the pipe feeding means. The use of a pipe feeding means permits more readily controllable, adjustable tension to be applied to the pipe during the bending so as to achieve compression bending, draw bending or a combination of the two for a given bend. Still another feature of the invention involves a pipe cutting arrangement associated with the bend head for severing an integral portion of the pipe only after such portion has been bent as desired. Principles of the invention are applicable to control of twisting, transport and cutting in pipe fabrication.

BRIEF DESCRIPTION OF THE DRAWINGS

FIG. 10 is a pictorial illustration of the pipe shearing assembly mounted on the bending machine;

FIG. 12 is a sectional view of portions of the pipe shearing assembly showing the shearing clamp blocks in upper position during a bending operation and before a shearing operation;

FIG. 14 shows the position of the shearing clamp assembly in relation to the backup bend die and pressure bolster at the completion of a shearing operation;

DETAILED DESCRIPTION

General System Description

Figure 1:
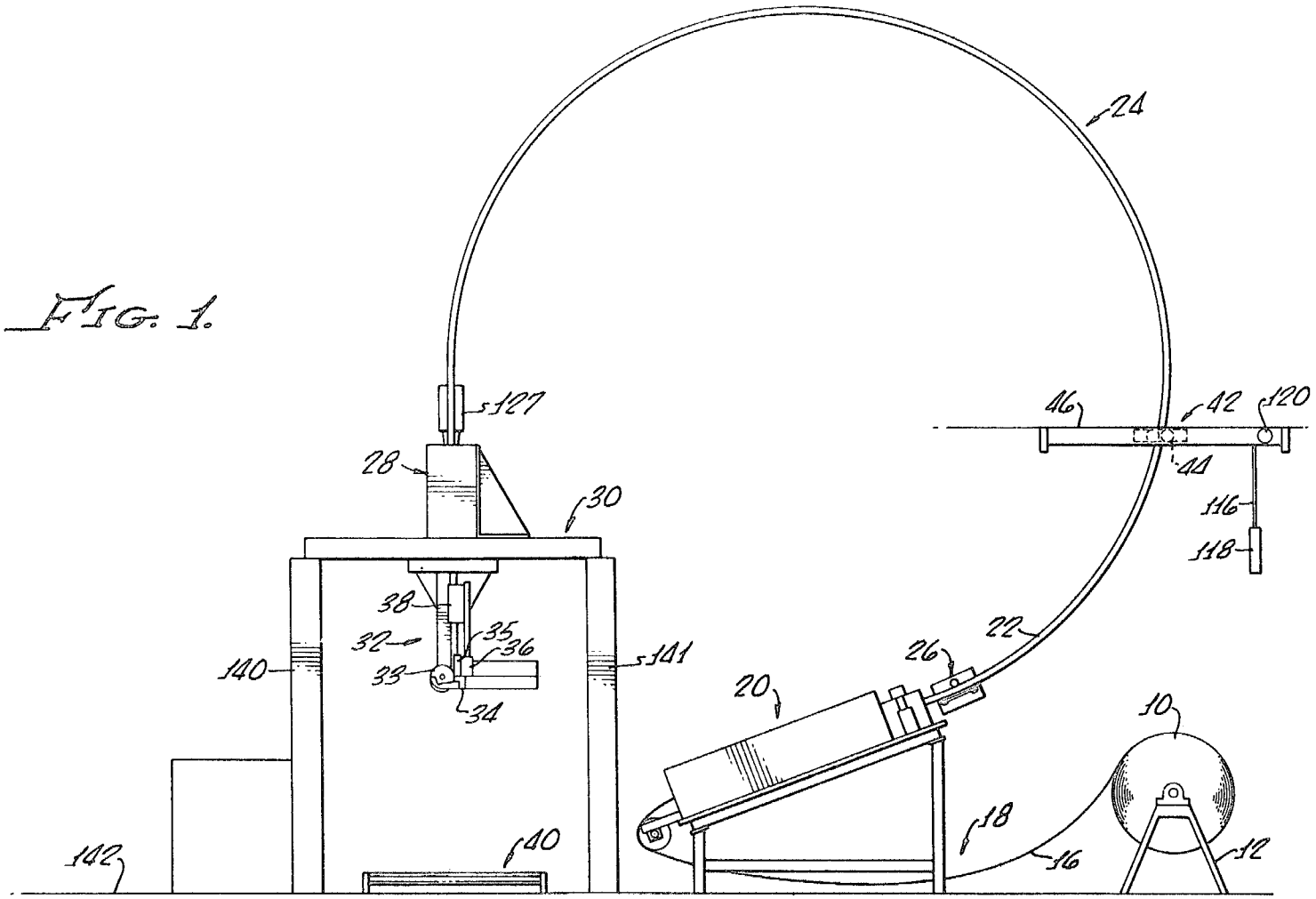
FIG. 1 is a schematic view of a pipe forming and bending system embodying principles of the present invention.

As illustrated in FIG. 1, a roll 10 of flat stock formed of a material such as steel, of which a length of pipe is to be made, is mounted on a fixed stand 12 to feed a continuous length of metal strip 16 along an extended generally curved path indicated at 18, to a pipe forming station 20. At the pipe forming station 20 the flat steel stock is bent longitudinally into a tubular configuration with juxtaposed edges which are welded, to provide a continuous run of welded pipe or tubing generally indicated at 22.

At the output of the forming station the pipe is curved, not straightened, by a plurality of rollers 26, to cause it to follow a non-linear path that provides variable storage and air cooling, prevents twisting, and facilitates transport and cutting of the pipe, as will be described more particularly below.

From the pipe curving rollers 26 the pipe extends along a curved path, generally indicated at 24, and thence to a pipe feeding station 28 fixedly mounted upon an overhead substantially horizontal platform or main bending support 30. Suspended from the platform 30 is a bending machine, generally indicated at 32, that is mounted for rotation relative to the platform about a vertical axis aligned with the pipe passing through the feeding station 28. The bending machine 32 is a substantially conventional bending machine, modified to operate in the described system, and may be of the type generally described in my above-mentioned U.S. Pat. Nos. 3,974,676 and 3,949,582 and in my co-pending application Ser. No. 692,585 filed June 3, 1976 for Apparatus for Bending Tube, and its parent application Ser. No. 614,946 filed Sept. 19, 1975 for Method and Apparatus for Bending Tubes, now abandoned. The disclosures of such co-pending applications are incorporated herein by this reference as though fully set forth. The entire bending machine, including the bending head and the bed on which the stationary and swinging arms thereof are carried, is all supported from the platform 30 and is all rotatable about the described vertical axis. This rotation is one of the changes made in the devices of the prior patents and applications, such devices previously employing a fixed horizontal bed and a vertical bend die axis. Another significant change is the elimination of the pipe feeding carriage and the use of the feeding station to advance the pipe. This simplified bending machine is described in detail hereinafter.

The bending head includes a rotary bend die 33, a clamp die 34 that rotates with the bend die, and a sliding pressure die 35 mounted on a pressure die bolster 36.

Slidably mounted upon the bending machine for cooperation with the pressure die bolster 36 and the bend die 33 is a shearing cutter assembly 38 that is operable to cut off an integral portion of the continuous length of pipe after a predetermined number of bends have been made therein. The severed portion of pipe will fall upon the bed of a conveyor 40, positioned below the bend head, and will be transported thereby for inspection and disposition as desired. The conveyor may be a part of or feed to a pipe inspecting apparatus of the type described in my patent application Ser. No. 704,408 filed July 12, 1976 for Method and Apparatus for Profile Scanning.

A pipe bending machine of the type described in the above-identified patents and patent applications, operates in a series of sequential steps, some of which are performed one at a time, although several operations may be performed together to increase bending speed. Initially, the pipe is advanced toward the bend dies to position a portion of the pipe to bend with respect to the bend and clamp dies. The pipe is also rotated about its axis to obtain the proper plane of bend. The amount of advancement determines the distance between bends. The pipe is then pressed against the rotating bend die by the clamp die and by a pressure die. The bend and clamp dies are rotated together to pull and bend the pipe around the bend die while the pressure die, pressing the pipe against the bend die, normally creates a frictional drag which restrains a rearward portion of the pipe. The amount of rotation of the bend and clamp dies determines the degree of bend. When this amount of rotation has been achieved, the clamp and pressure dies are retracted, the bend and clamp dies are rotated back to their original position, and the pipe is ready to be advanced and axially rotated for the next bend. It will be appreciated that this bending process requires only intermittent advancement of the pipe. Moreover, the actual advancement of the pipe may occur at different rates during a given bend. Thus the rate of advancement of the pipe as it moves to position with respect to the dies for a bend may be different than the rate of advancement of the pipe as it is pulled around the bend die during the forming of a bend. Further, during the retraction and return of bend and clamp dies, other rates of advance may be employed, or there may be no advancement of the pipe at all.

The pipe forming machine is preferably operated continuously at a fixed speed. Many types of welding are most efficient at constant speeds. Thus, even though the average rate of feed for the bending machine may be controlled to be substantially equal to the speed of the forming machine, the intermittent operation of the bending does not permit a direct continuous feed of pipe from the forming station. Further, for long periods of operation, even small differences between forming rates and average bending rates will accumulate and reach intolerable magnitude.

In an embodiment that has been built, the pipe is formed at a rate slower than the rate at which the bending machine can bend the pipe. Accordingly, the pipe storage loop or curved path 24 is provided between the bending (or feeding) and forming stations. This loop is arranged to store a variable length of pipe. Theoretically, variable storage capacity is not required if the rate of bending and the rate of forming of the pipe are precisely equal. However, as previously stated, it is not possible to make these rates exactly equal and one operation may be intermittent or variable and the other may be continuous and fixed. In general, the bending and forming stations operate asynchronously and at mutually different speeds. To compensate for this, the difference in the rate of pipe forming and the rate of bending is detected and at least one of the rates is controlled so as to minimize such difference.

The difference in rates is indirectly detected by detecting the amount of pipe in the storage loop. This is achieved by a pipe storage detector generally indicated at 42 having a pipe follower 44 that moves relative to a fixed follower guide 46 in accordance with motion of the pipe in the storage loop, as the amount of pipe in the loop varies. Thus, as pipe is bent more rapidly than pipe is formed, the amount of pipe in the path between the forming station and the bending station is decreased, the curvature of the storage path or loop is increased, and the section of stored pipe that extends through the follower 44 will move toward the left (as viewed in FIG. 1). Conversely, if bending takes place more slowly than forming, the length and curvature of pipe in the storage loop increases, and the follower moves toward the right. Motion of the follower 44 produces an electrical signal that is fed to control the relative rates of forming and bending, as will be more particularly described below. In effect, closed loop servo control of the pipe storage loop is achieved by detecting changes in the amount of stored pipe and controlling difference between bending and forming rates to minimize such changes.

Pipe Forming Station

Various types of tube mills for longitudinally bending flat strips into tubular form and welding juxtaposed edges are known, including such devices as are shown in U.S. Pat. Nos. 2,716,692; 2,796,508; 2,844,705; 3,131,284 and 3,590,622. In general these are designed for high manufacturing rates at speeds in the order of 50 to 100 feet per minute, or more, and include a series of rollers for longitudinally bending flat strip, plasma or other conventional inert gas welding, or induction welding for very high rates of tube forming. Various arrangements are used for cooling, working or straightening the welded tube. In most tube forming from flat stock, longitudinal stretching of the stock edges during the forming and heat added by the welding result in tendencies of the finished pipe to transversely bend in one direction or the other. Thus it is common to position a tube straightener immediately after the welding step. In addition, some type of liquid cooling is often employed.

Such tube mills tend to produce pipe that twists about its longitudinal axis, having a spiralling weld seam. Nevertheless, no economically feasible methods, except those to be described below, are known to applicant for satisfactorily eliminating this twist. The twist is due, in part, to the fact that the flat stock from which the pipe is made is generally cut from wide sheets of stock and different lateral portions of such sheets have different properties that cause the sheets to react differently to the pipe manufacturing processes.

In the tube forming station of the present system, longitudinal bending is greatly simplified. In some embodiments the pipe is transversely curved after it is welded, to cause it to pass along a curved path. This curved path, in addition to providing variable length pipe storage between the forming and bending stations, improves the forming itself. The curved path also functions to provide an air cooling station, to prevent twist of the pipe about its longitudinal axis, and to facilitate transport and cutting of the pipe. The present tube forming may use fewer rolls than conventional tube mills, and further, may drive such rolls by means of chains rather than precision gears by virtue of its operation at a considerably slower speed. In the present system the tube forming station is operated at a speed that produces about 15 lineal feet of pipe per minute, which significantly alleviates many of the operating problems.

Figure 2:
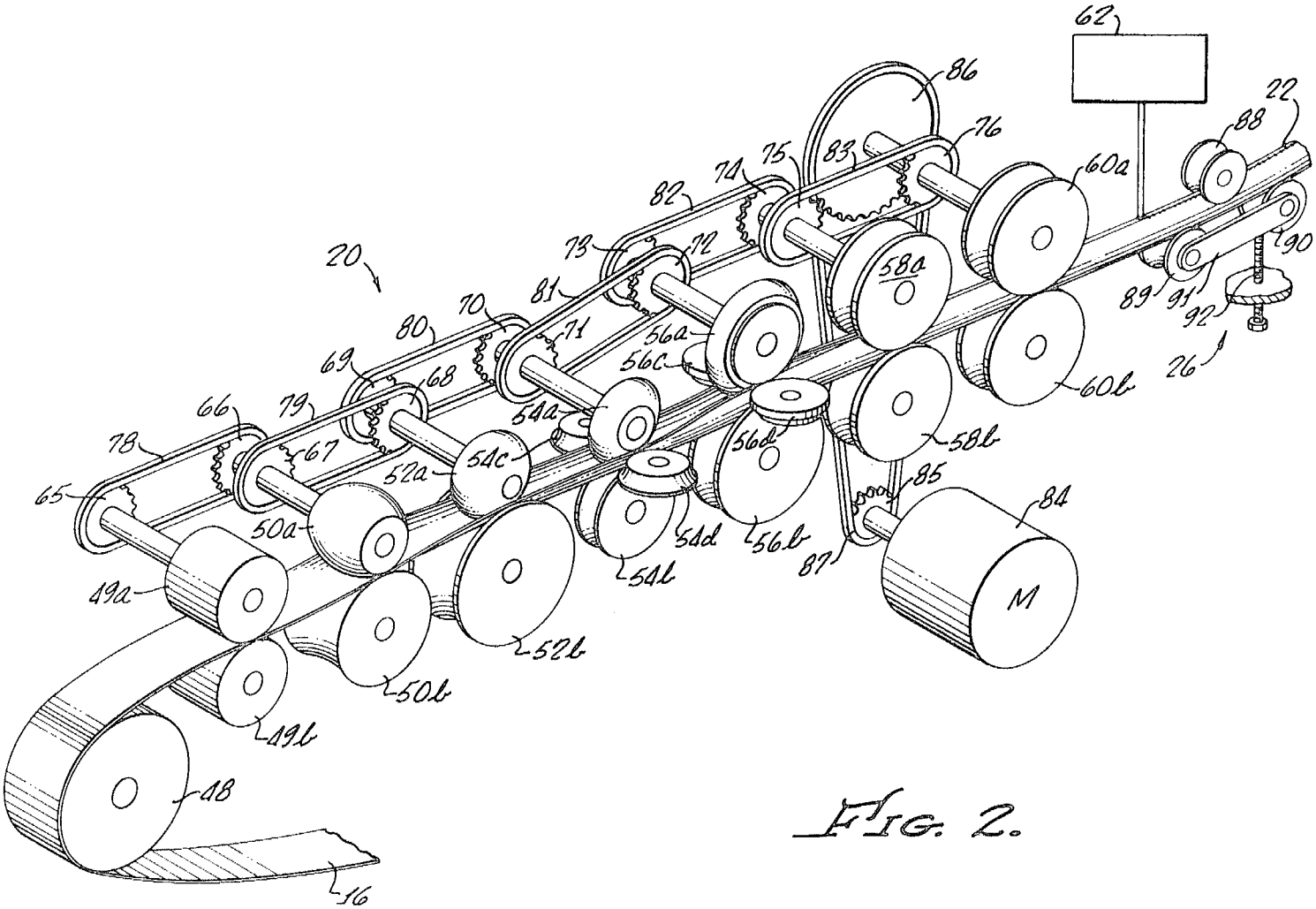
FIG. 2 is a perspective view of a major operating components of the pipe shaping and welding station.

The pipe forming station 20 draws flat steel stock from the slack curved stock loop 18 that extends between the input of the forming machine and the storage roll 10. As illustrated in FIG. 2, the flat stock is initially drawn around an input roller 48 and then passed between a series of pairs of opposed rollers 49*a* and 49*b*, 50*a* and 50*b*, 52*a* and 52*b*, 53*a* and 53*b*, 54*a* and 54*b*, 56*a* and 56*b*, 58*a* and 58*b*, 60*a* and 60*b*, which progressively bend the flat stock longitudinally and, assisted by lateral rollers 54*c*, 54*d* and 56*c* and 56*d* that cooperate with the roller pairs 54 and 56, bend the side edges of the longitudinally bent pipe inwardly into mutual juxtaposition, in which position they are welded to each other by means of a conventional electric arc welder 62. Preferably an inert gas shielded plasma welder such as Control Console WC 100 and Welding Torch PW/M-6A, both made by Thermal Arc, are employed. One roller of each pair of the rollers 49 through 60, except for the lateral rollers 54*c* and 54*d* and 56*c* and 56*d*, is directly driven by means of a series of gears 65, 66, 67, 68, 69, 70, 71, 72, 73, 74, 75, and 76, which are interconnected by chains 78, 79, 80, 81, 82, and 83, and driven from a motor 84 via gears 85 and 86 which are interconnected by a main drive chain 87. The continuous length of completed pipe passes from the welder to the curving rollers 26, and thence in an upward curve to the detector 42 (FIG. 1).

Loop Storage

The curving rollers comprise rollers 88 and 89 mounted on fixed axes spaced longitudinally along the pipe and respectively above and below the pipe. A third adjustable curving roller 90 is mounted on a pivotally adjustable arm 91 that is movable toward and away from the pipe about the axis of roller 89 by means of an adjustment screw 92. This curving arrangement is employed instead of the straightening arrangement of the conventional tube mill and insures that the pipe leaving the forming station will have a sufficient curvature to cause it to follow the curved path of the storage loop. Thus the curving rollers 26 impart a curvature to the pipe that is more or less equal to the curvature of the pipe in the curved storage loop 24, although as will be apparent, the curvature of this loop varies as the amount of pipe stored in the loop varies.

Figure 3:
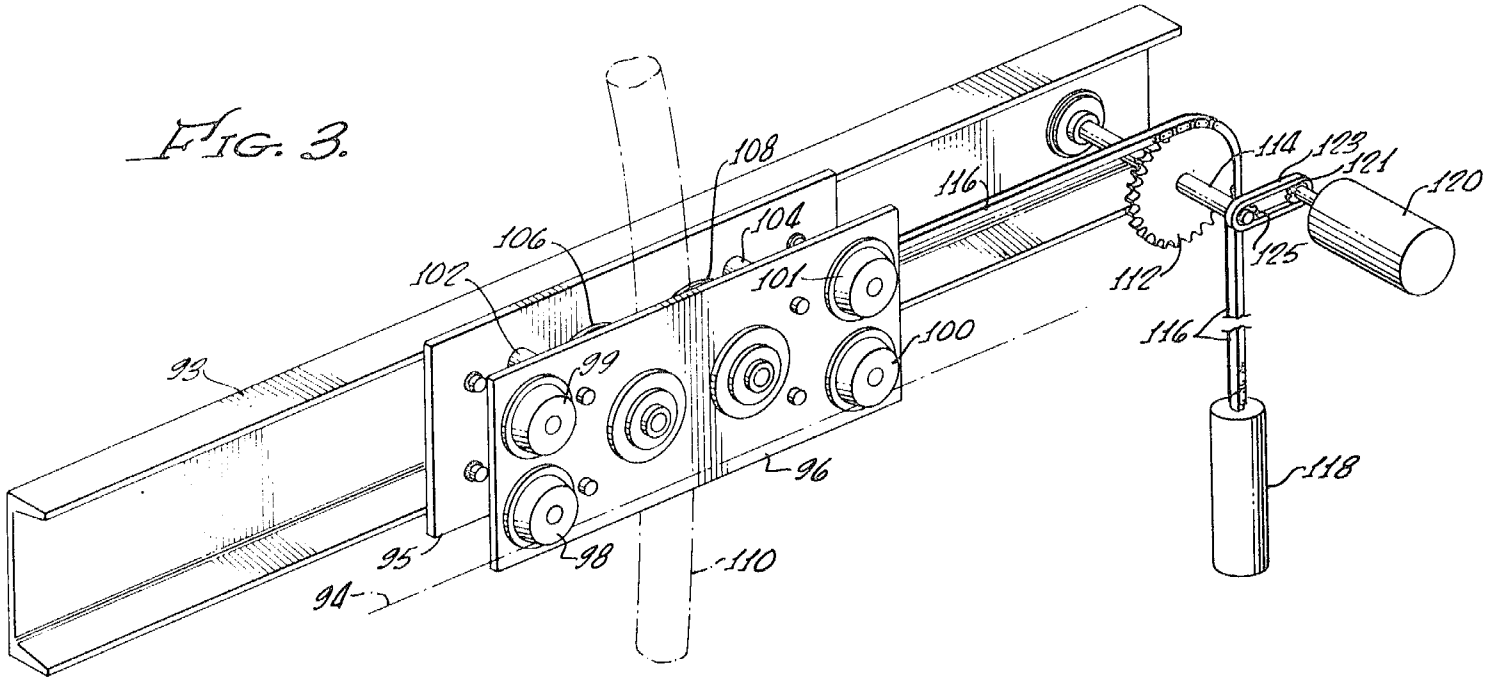
FIG. 3 is a pictorial illustration of a storage loop position detector with parts removed for clarity of the drawing.
Figure 4:
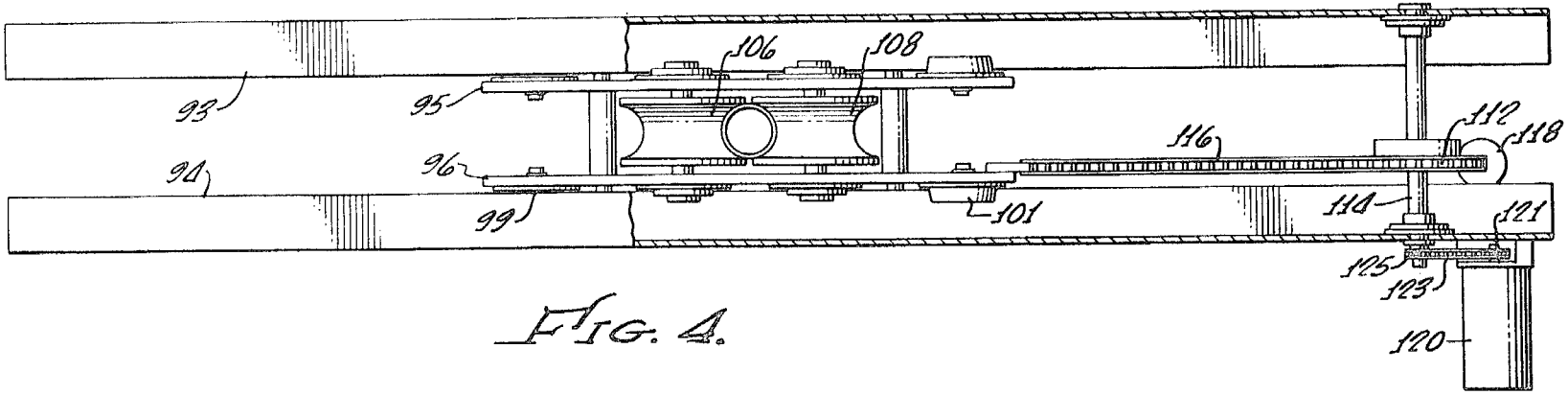
FIG. 4 is a plan view of the position detector of FIG. 3.

As shown in FIGS. 3 and 4, detector 42 comprises a pair of fixed guides or steel channels 93, 94 mounted in horizontal position at a point laterally spaced from and above the output of the forming station so that the pipe will extend outwardly and upwardly from the forming station to the detector. As can be seen in FIG. 1, the forming station is mounted at an angle to the horizontal so that the longitudinal extent of the pipe as it progresses through the various forming steps, inclines upwardly from the end at which the flat stock is taken in to the end at which the continuous completed length of pipe is driven out.

Slidably mounted in guides 93, 94 is the follower which is formed by a pair of side plates 95, 96, each having a pair of laterally outwardly projecting rollers, such as rollers, 98, 99, 100, 101, that are respectively received and guided in the guide channel 94, and a corresponding group of rollers on the other side that are guided in channel 93. Plates 95, 96 are fixedly secured to each other in mutually spaced relation by a plurality of spacer rods, such as rods 102, 104, and rotatably mount a pair of mutually spaced follower rollers 106, 108 that have curved peripheries collectively defining a substantially circular aperture that closely confines and slidably receives the pipe portion 110 that extends through the detector. A gear 112 is journalled on a horizontal shaft 114 that is fixed to the guide channels 93, 94 and entrains a chain 116 fixed at one end to the detector follower plate 96 and suspending a weight 118 at the other end.

Also mounted by suitable means (not shown) in association with the detector follower is a rotation sensor 120 having an input shaft pinion 121 driven by a chain 123 that is entrained on a gear 125 fixed to the end of shaft 114. The encoder or rotation sensor 120 produces an electrical signal that indicates the amount of rotation of shaft 114. Thus, if the bending progresses at a rate greater than the rate of pipe forming, the amount of pipe in the storage loop decreases, the diameter of the loop increases and the length of the loop itself becomes smaller (since the loop ends are effectively fixed at the feeding station and curving rollers, respectively). The portion 110 of pipe in the loop that extends through the detector follower thereupon moves toward the left, carrying the entire detector follower carriage to the left and sliding the detector follower carriage along its guide channels. Chain 116 is also pulled to the left as the carriage moves, thereby rotating the encoder input pinion 121 whereupon the detector encoder 120 produces an electrical signal that represents displacement or position of the pipe portion 110 and therefore represents the change in the amount (or actual amount) of pipe in storage. This electrical signal is employed in a manner to be more particularly described below to either completely stop the bending operation and the feeding of pipe to the bending machine from the feeding station or to change the speed of the bending and feeding so as to minimize changes in the amount of pipe in the storage loop.

It will be readily appreciated that there are many different ways for detecting and relatively adjusting the rates of pipe forming and pipe feeding and bending. Thus it is possible to control either the forming rate or the bending rate, or both, as deemed necessary or desirable. The system may be operated so that when the position signal from detector encoder 120 indicates that the storage is less than a predetermined minimum amount, the entire bending and feeding operation is stopped. As a corollary the bending and feeding operation will not start until the amount of pipe in the loop has increased beyond such predetermined minimum. With the amount of storage in the loop above this predetermined minimum, a nearly continuous and proportional control of feed and bend rates is achieved in response to the signal from detector encoder 120. Thus if the signal indicates an amount of pipe in storage below a reference amount (which reference is, of course, greater than the previously described predetermined minimum), the rate of feeding and bending may be decreased whereas if the signal indicates an amount of storage greater than such reference value, the rate of feeding and bending may be increased. It is contemplated, alternatively, that the bending and feeding be merely controlled to be either on or off, always operating at a fixed rate when it does operate. Thus the bending may be stopped when the storage is below a first amount and started when the storage is detected to be above a second amount, it being assumed that the pipe forming is continuous in the described arrangements.

For a typical one and one-half inch diameter pipe, storage loop 24 may have a diameter in the order of twenty to twenty-two feet. If deemed necessary or desirable, additional movably mounted idler rollers or guides (not shown) may be provided to lend further support to the pipe as it moves through this changeable length storage path.

When the system is first started up and pipe first begins to leave the forming station, the pipe is bent by the curving rollers 26 and then will substantially automatically assume the illustrated curved loop configuration. The pipe, as it leaves the forming station, is readily guided by hand through the detector, thence along the path of the curved loop and into the feeding station 28. Once gripped by the rollers of the feeding station, no further manual control of the loop configuration is necessary.

If a smaller diameter storage loop is desired, the pipe may be formed with an oval or elliptical cross-section instead of the circular cross-section that results from the forming station described herein. Such an elliptical cross-section would have its major axis lying in a plane perpendicular to the plane of the storage loop and its minor axis lying in the plane of the storage loop, whereby the pipe may be bent into a loop of smaller diameter without stressing the pipe beyond its yield point. If such flattened pipe is employed, a series of reforming rollers are provided at the feed station to reform the pipe to the desired circular cross-section.

As previously mentioned, a repeatable and identical position of the weld seam for bending each pipe section is desirable for repeatability and accuracy of precision bending. Surprisingly and unexpectedly the curved variable length pipe storage additionally provides a highly stablized loop which has proved to be a configuration that inherently resists twisting of the pipe. The curved storage loop carries or guides the pipe along a series of points that are displaced from the axis of the pipe at the forming station. Stated another way, because the pipe is curved as it leaves the forming station, it is all shifted off the axis of the pipe which is in the station. Thus if a force acts upon the pipe at a point that is remote from the forming station, and such force restrains rotation of the pipe about the pipe axis at the forming station, twisting of the pipe about such axis is readily prevented. Such a restraining force, at a point that is displaced from the axis of pipe at the forming station provides a long lever arm (e.g., the distance by which the pipe is displaced) so that a large restraining torque about the axis of the pipe at the forming station is readily exerted by a small force.

In the illustrated embodiment, the pipe is restrained against rotation about the axis of pipe in the forming station by both the loop position detector 42 and by the feeding station. Any tendency of the pipe to twist tends to rotate the entire loop about the pipe axis at the forming station and this rotation is resisted at each of the detector 42 and feeding station 28, which exert a restraining force on the pipe in a direction perpendicular to the plane of the loop, as viewed in FIG. 1. Further, any tendency of the pipe to twist at the feeding station, about the axis of pipe in this station, is resisted by the detector and the forming station. Thus, surprisingly and unexpectedly, the storage loop itself prevents twisting of the pipe and automatically insures that the weld seam will be identically positioned for each bend made by the bend head.

Still another unexpected advantage of the described storage loop, is its inherent cooling effect. The loop acts as an air cooling station, and thus enables elimination of the conventional liquid cooling system at the output of the forming station, which is employed to remove the heat added by the welder.

Although it is presently preferred to employ a planar and basically circular storage loop, wherein axes of pipe in the feeding and forming stations (together with the stored pipe) 183 lie in a common vertical plane, it is contemplated that other loop configurations, non-circular and spiral or non-planar, may be employed, and the loop orientation may be horizontal or some other non-vertical arrangement.

Feeding Station

The pipe from the storage loop 24 moves downwardly into the feeding station 28 along a vertical path. As shown in FIGS. 1, 5, 6 and 9, the feeding station comprises first and second pairs of mutually opposed rollers 122*a*, 122*b* and 124*a*, 124*b*, mounted by a feed support frame 135 and gusset plate 136 to the fixed, overhead platform 30 that includes structural cross-beams 138, 139, supported by columns 140, 141 (FIG. 1) and others (not shown), above the floor 142 upon which the entire system is carried.

The feed roller pairs 122 and 124 are spaced from each other along the vertical axis of the pipe. Interposed between these pairs is a pipe straightening roller 143 that is journalled to bear upon the outer convex side of the pipe as it comes out of the curved storage loop to straighten the pipe for the ensuing bending operation. As compared to a conventional tube mill, the present system places the pipe straightening rolls at a point remote from the welder, and interposes a series of pipe curving rollers and an anti-twist, air cooling loop of pipe.

Feed rollers 122*b* and 124*b* are directly driven from interconnected gear boxes 125, 126, both of which are driven by an electric motor 127. Rollers 122*a* and 124*a* are driven via gears 128, 129 fixed on the roller shafts and meshing with gears 130, 131 that are fixed on the shafts of directly driven rollers 122*b*, 124*b*.

A feed position detector (FIG. 5) comprises a sensing roller 145 mounted in rotatable contact with the pipe so as to be rotated thereby as the pipe is fed through the feeding station. Roller 145 drives the input shaft of a rotation readout or encoder 147 which provides a feedback signal representing feed displacement, which signal is used in conjunction with a variable rate clock pulse to control the feeding rate as will be more particularly described hereinafter. The feed rollers tightly grasp the pipe so that longitudinal motion of the pipe is controlled by rotation of the rollers.

Bending Station

Fixed to and depending from the underside of platform 30 is an outer annular bearing race 144 (FIGS. 5 and 6) that cooperates with an inner annular bearing face 146 fixed to a rotary bend head support plate 148 to rotatably suspend the latter from the platform for rotation about a vertical axis aligned with the axis of the pipe leaving the feeding station 28. Plate 148 is annular and centrally apertured to receive the pipe that is fed therethrough from the feeding station. Fixed to and vertically depending from the bend head support plate is a bend head support frame or machine bed 150. The machine bed is conveniently formed as a suspended column of rectangular cross-section that is secured to plate 148 by means including stiffening gussets 152, 154. The machine bending head, including the several dies and operating mechanisms therefor, are mounted to the bending machine bed for rotation therewith about the axis of the bearings 144, 146. Thus, provision must be made to carry the electrical and hydraulic lines from sources of electrical power and pressurized hydraulic fluid to and from the bending machine across the rotary joint of the bend head support plate.

Figure 7:
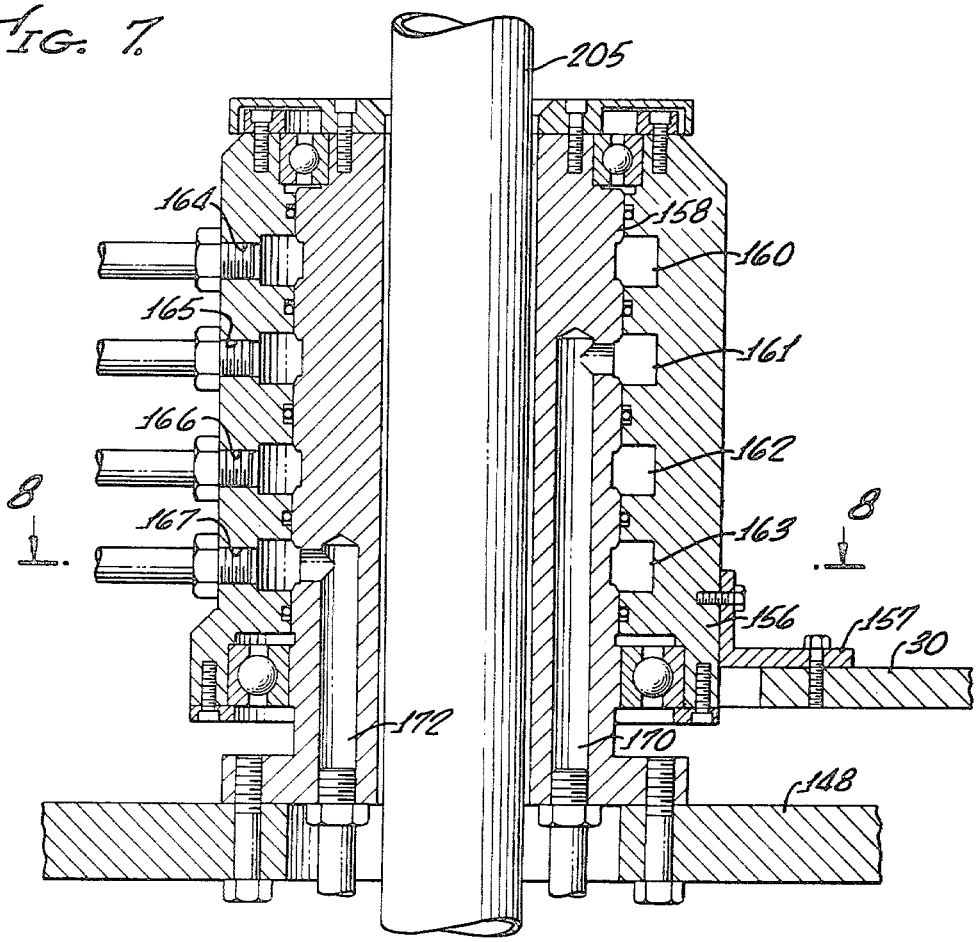
FIGS. 7 and 8 illustrate details of a rotary hydraulic joint.
Figure 8:
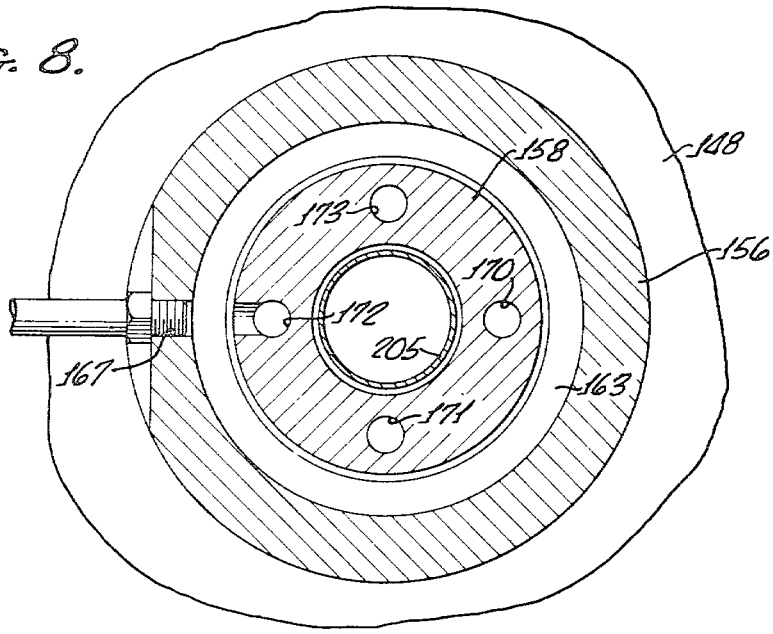

To this end a rotary hydraulic joint is provided as illustrated in FIGS. 7 and 8. The rotary joint includes an outer section 156 having a cylindrical bore and fixedly mounted to the fixed platform 30, as by a plurality of brackets, one of which is shown at 157. The rotary joint includes an inner section 158 rotatably mounted within the cylindrical bore of the outer section 156. The inner section is fixed to and carried by the rotary bend head support plate 148. Annular outer section 156 is formed with a plurality of axially spaced circular passages 160, 161, 162 and 163, each connected at ports 164, 165, 166 and 167, respectively, to pressure and return hydraulic lines connected to the two pumps employed in operation of the several hydraulic cylinders of the bending machine. Lines at ports 164, 165 are connected to a first pump 168 that provides pressurized fluid to the hydraulic motor that rotates the bend die. Lines at ports 166, 167 are connected to a second pump 169 that provides pressurized fluid to all of the other hydraulic motors of the bend head.

The inner joint section 158 is formed with a central bore aligned with the axis of the pipe feeding station and of a size to slidably receive the pipe as it is fed from the feeding station through and across the rotary joint. Inner section 158 is also formed with a plurality of circumferentially spaced blind bores or conduits 170, 171, 172, 173, all of which extend through the lower end of the rotary joint and through the rotary bend head support plate 148. These bores are connected to hydraulic lines that are mounted on the rotating bend machine and connected to the several hydraulic motors thereof by means of electrically controlled valves 174 carried on a valve plate 175 fixed to the machine bed. Each of the bores is connected at its inner or upper end to a respective one of the annular conduits or passages 160 through 163. The various hydraulic lines on the bend head are omitted from the drawing for clarity of illustration.

Figures 5, 6:
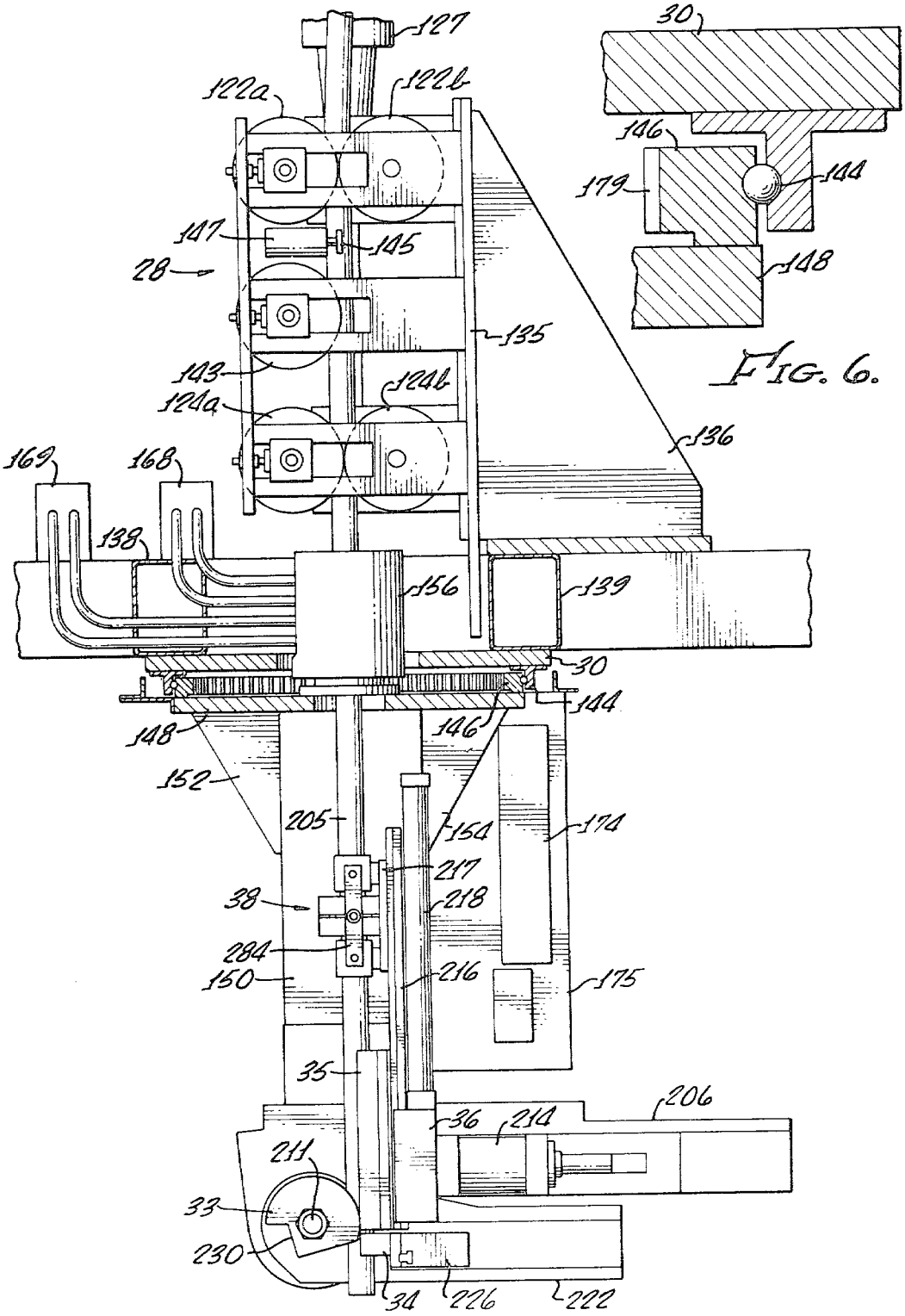
FIG. 5 illustrates the mounting of the feed station and rotatable bend station on a fixed platform.
FIG. 6 is an enlarged detail of the rotatable support of the bend station.
Figure 9:
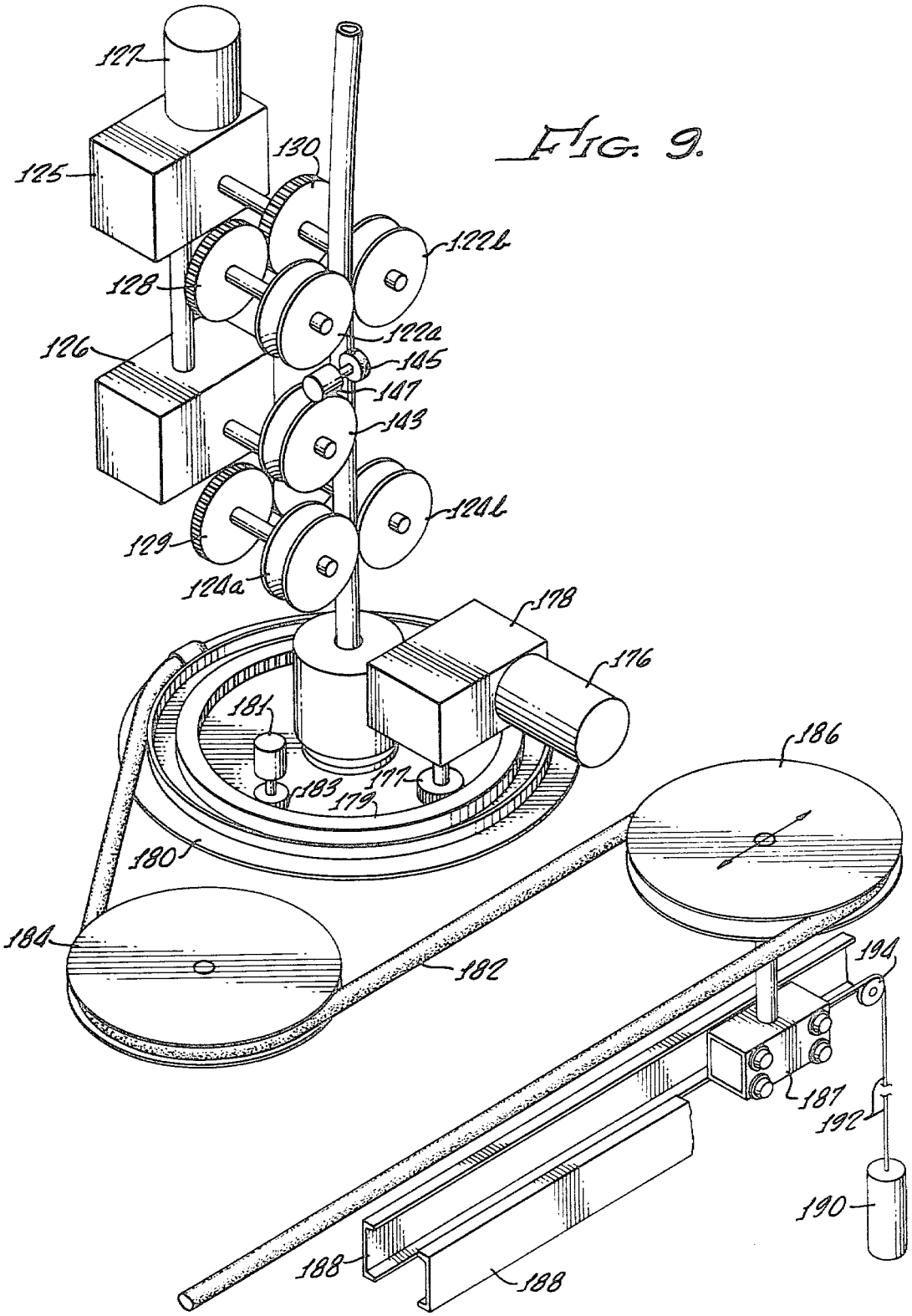
FIG. 9 is a pictorial illustration of major operating components of the feed station and the rotational drive for the suspended bending machine.

As seen in FIG. 9, the rotary bend head support plate 148 is driven by means of a motor 176 fixed to the platform and connected to drive a pinion gear 177 via a gear box 178. Pinion 177 meshes with teeth of a ring gear 179 fixed to the inner bearing race 146 (FIG. 6). A plane of bend encoder 181 is driven by a gear 183 that meshes with ring gear 179 to provide an electrical position feedback signal to be described below.

Rotary bend head support plate 148 carries a peripheral circular angle 180 that loosely guides a system electrical cable 182 which is partly wrapped and unwrapped around the angle 180 as the bending machine rotates. The cable carries electrical signals between the bend head and the machine controls. Slack in the electrical cable 182 is taken up by a system of idler pulleys 184, 186 of which the latter is journalled on a carriage 187 movably mounted for horizontal motion in a pair of slide channels 188. Pulley 184 is journalled about a fixed axis. As the bending machine rotates in one direction, cable 182 is wound further about the angle 180 and idler pulley 186 moves in one direction along its tracks 188. The idler pulley is urged in an opposite direction along its tracks by means of a weight 190 connected to pulley 186 via a line 192 that is entrained over a linde guide 194.

The use of electrical cables, while providing a simple and direct arrangement for the transfer of electrical signals across the rotary joint of the bending station (between the machine controls, fixedly mounted near the bend head platform, and the sensors and electrically controlled hydraulic valves on the rotating bend head) does in fact limit the rotation available. Rotation of a full 360° or more is limited by the length of the electrical cable and the amount of cable that can be coiled in the cable guide angle. Using a slack loop cable across the rotary joint requires the bend head to move about its machine rotation axis (the vertical axis, as illustrated in the drawings) in directions dictated, at times, by the length of the cable rather than by the shortest rotational distance from one rotational position to another. Thus, although it may be shorter in degrees of rotation, to move from one plane of bend position to a next in a clockwise direction, for example, limited length of the electrical cable may require that the motion from one position to the other be achieved in a counterclockwise direction and thus over a longer path, and requiring a greater time. To avoid this problem, the electrical signals can readily be transmitted across the rotary machine joint by a number of well known devices that will permit unlimited rotation. Such devices include slip rings, rotary transformers, selsyns, or wireless devices, such as a radio transmitter, for example. Electrical information is provided in serial pulse form and thus one needs only two channels for input electrical signals and two channels for output electrical signals so that if a common ground is used, only three completely rotary transmission channels are provided across the rotary joint.

The bending head itself employs bending components that are identical to the components of the bending machine described in the above-identified co-pending patent application Ser. No. 692,585, except for certain modifications to be described. Primarily the bending machine of the present system differs from the prior machine in several respects. The machine is oriented with its bed extending vertically rather than horizontally, as in the prior machine. There is no carriage and chuck for grasping and moving the pipe toward the bending dies since the feed station provides the advancing function and the rotary bearing provides the rotation function. Further, the pressure die is not used normally for axial restraint of the tube as desired for draw bending since tension is readily controlled by control of bend and feed rates. In addition, a pipe shear assembly is provided.

Basically the machine bed is provided by the bend head support frame 150 which carries the bend head itself. The latter comprises stationary and swinging arm assemblies. The stationary arm assembly 206, is fixed to frame 150 but may be adjustably mounted on the frame as described below in connection with FIGS. 20 and 21. It has mounted thereon the pressure die bolster 36 for sliding motion (from right to left and left to right, as viewed in FIG. 5) toward and away from the bend die 33. A pressure die pressure cylinder 214 is mounted on the stationary arm assembly 206 for driving the bolster toward and away from the bend die. Slidably mounted in a T-shaped guide in bolster 36 for motion parallel to the axis of the pipe 205, and transverse to the direction of motion of the bolster 36, is the T-shaped pressure die slide 216. The slide is driven along its path, parallel to the pipe 205, by means of a boost cylinder 218 and mounts the detachable pressure die 35, all as described in further detail in the above-identified co-pending applications Ser. No. 692,585, filed June 3, 1976, and Ser. No. 825,554, filed Aug. 18, 1977.

Figure 15:
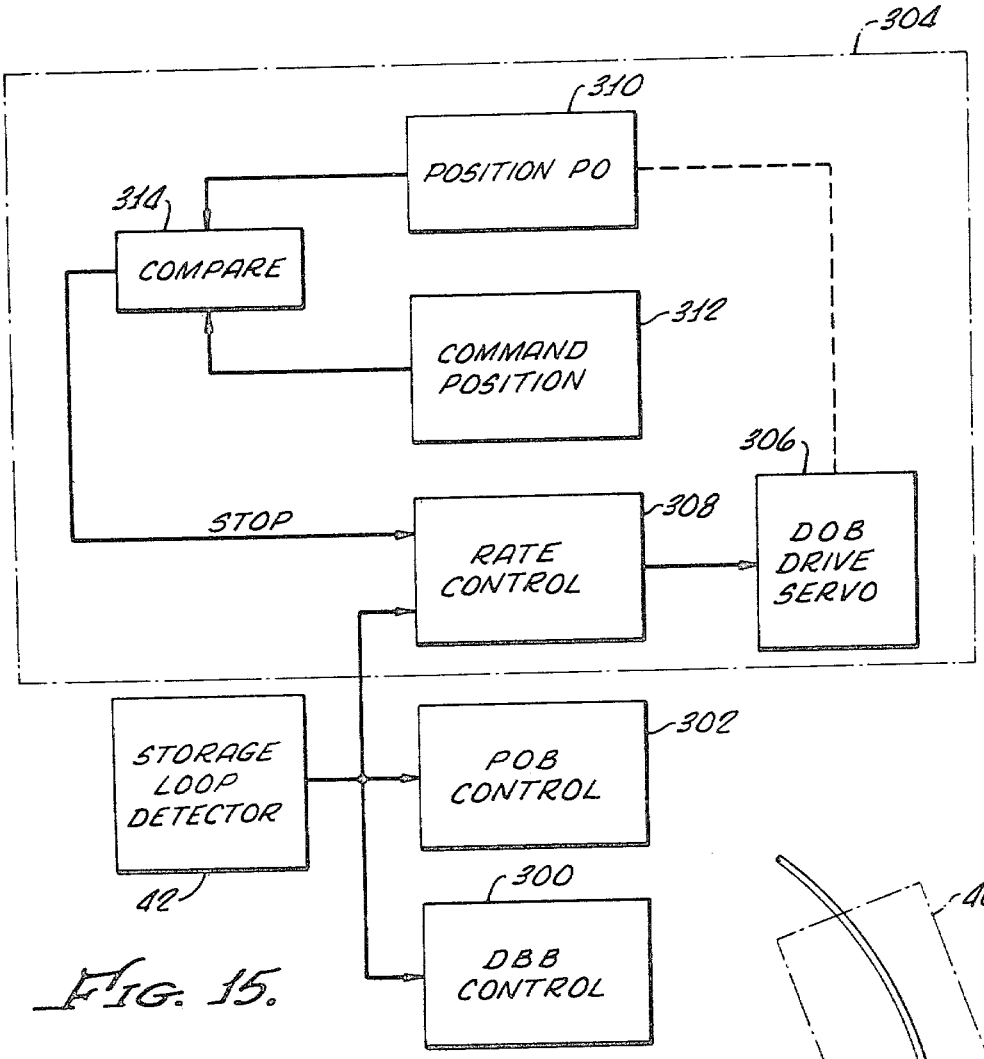
FIG. 15 is a functional illustration of speed control for the feeding and bending stations.

A swinging arm bend assembly 222 is mounted to the stationary arm assembly for rotation about a horizontal axis 211 (the axis of rotation of the bend die) and fixedly carries the bend die 33, the rotational position of which is sensed by a bend die shaft position encoder 223 (FIG. 15). Movably mounted on the swinging bend arm assembly is the clamp die 34 which is moved toward and away from the bend die, to clamp and unclamp a pipe interposed between the clamp and bend dies. The clamp die is driven by means of a clamp drive mechanism generally indicated at 226. Details of the bend, clamp and pressure dies, their hydraulic drives, and their mounting are the same as corresponding components disclosed in the above-identified co-pending applications. However, the shape of the bend die is modified and the slide is extended for use in the pipe shearing as will be described hereinafter.

Pipe Bending

To bend a pipe with the bending machine described herein, the feed station is operated to advance the pipe so that a point of the pipe at which a bend is to be commenced is positioned between the mutually opposed clamp and bend dies. This advance controls distance between bends. The entire bending head is rotated to define the selected degree of bend. The clamp die is pressed toward the bend die to clamp the interposed pipe between the bend and clamp dies. The pressure die is moved laterally of the pipe, toward the bend die by means of the pressure die bolster and pressure die cylinder 214. If desired, the initially retracted clamp and pressure dies may start to move toward the pipe as the pipe is advanced by the feeding station and as the bend head is rotated for plane of bend. The swinging bend arm assembly, including the clamp die and bend die, are rotated about the axis 211 of this swinging assembly. In the course of this rotation, the pipe is pulled around the bend die and bent around the bend die while feeding of the pipe by the feed station continues. Control of the rate of feeding during the rotary motion of the swinging arm assembly, to achieve a combination of compression and draw bending of the type described in my above-identified patent applications Ser. No. 692,585 and Ser. No. 825,554, will be described in further detail hereinafter.

Although the various bending steps are most readily described as occurring in sequence, one after the other, it will be readily appreciated that several of the steps can be performed simultaneously and that many will occur at least in partially overlapped time relation. For example, as the feeding station is advancing a pipe to position it for a bend, the previously retracted clamp and pressure dies may be simultaneously starting their motion toward the bend die. Further, the entire bending machine may be rotating to obtain the desired plane of bend.

Upon completion of the bend, the pressure and clamp dies are retracted, the pipe is again advanced from the feeding station to the predetermined distance between bends, the bending machine is rotated for plane of bend and a second bend is commenced. Additional bends are made as desired until the final bend of a given part has been made. During these bending steps, the feeding station is feeding pipe at the various rates required and even stopping momentarily, as when the clamp and pressure dies reach pipe engaging position (before bend die rotation commences) and after the last bend has been completed, for example. The pipe forming may be operating at its continuous fixed rate during all of the bending steps. Thus the amount of pipe stored in the loop will vary to cause the various bending steps to change spaced as will be described below.

Pipe shearing

After the last of a series of bends is made on a given section of pipe, the pipe is severed by the pipe shearing assembly and drops to the conveyor 40 as previously described. Pipe shearing assembly 38 is fixed to a rearward extension of slide 216 so that it is always positioned to the rear of the pressure die 35, but may be slidably moved forward from a rearward position (illustrated in FIG. 5) to a forward operating position (illustrated in FIG. 13) wherein it is juxtaposed to and between the pressure die bolster 36 and a portion of the bend die 33. The shearing assembly is wider than the space between the retracted pressure die and bend die and will not clear the bend die (in normal position) as the slide moves forward. To increase retraction of the pressure die would require lateral displacement of the shearing assembly (to clear the bend die) and could cause the pipe to be bent as it is sheared. Therefore, to accommodate the shearing assembly, the bend die has a portion of its periphery, opposite the curved peripheral portion employed for the bending, cut away to provide a flat backup surface 230. This surface bears against the shearing assembly to resist lateral forces applied to the assembly by the bolster during the cutting operation (see FIG. 13). Thus the shearing assembly clamping portion is caused to clamp the pipe for the cutting by being pressed between the bolster and the backup surface 230 of the bend die. An alternate arrangement, presently preferred, is described below wherein the entire swinging arm assembly, including the bend die, is shifted to accommodate the shearing assembly.

Figure 11:
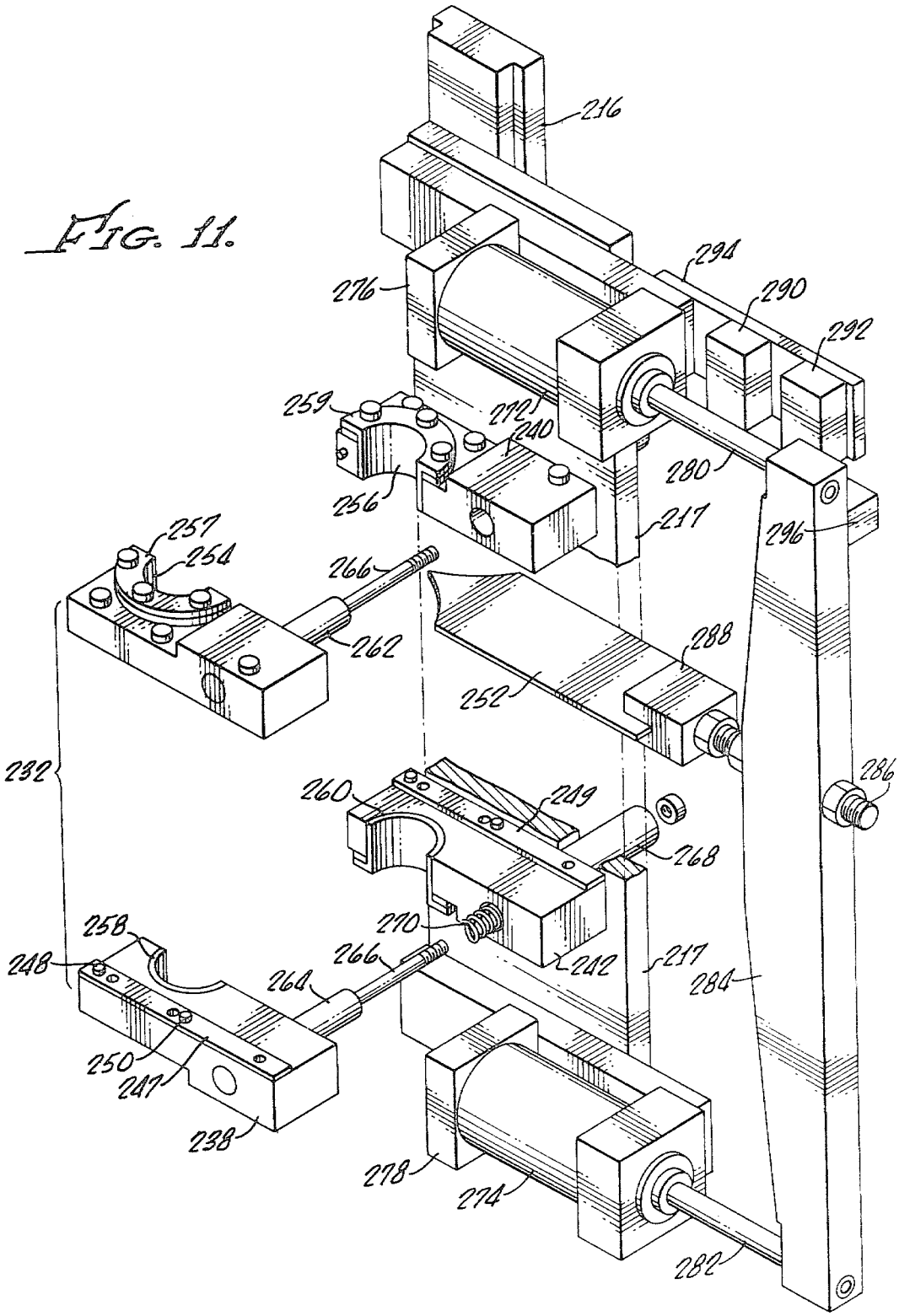
FIG. 11 is an exploded pictorial illustration of major operating components of the shearing clamp assembly.

Referring now to FIGS. 10, 11, 12, 13 and 14, the shearing assembly, including clamp blocks and cutter guide, comprises a split clamp having first and second clamping blocks 232, 234. Each clamping block is formed of a pair of clamp block sections 236, 238 and 240, 242, with the sections of each block being fixedly bolted together in mutually spaced relation by means of bolts **244*a*, 244*b* and 244*c* for block 232 and similar bolts 246*a*, 246*b*, and 246*c* for block 234. The two sections of each clamp block are held in close but mutually spaced relation by means of spacer 247, 249, held by pins 248, 250 to define between the sections of each block, a blade channel or guideway that slidably receives the end of a shearing cutter blade 252. Each of the clamp block sections is formed with a portion of a pair of mating cavities, such as cavity portions 254 and 256, which cavity portions are lined by replaceable flanged sleeve sections 257, 258, 259 and 260 (FIG. 11**). If deemed necessary or desirable, rollers (not shown) may be positioned on the cutter assembly adjacent the surfaces of the cavity therein to space the clamps from the pipe by a few thousandths of an inch, thereby to minimize scoring of the pipe by the cutter clamp block insert edges. Such spacing is sufficiently small so as to provide a negligible interference with the clamping of the pipe by the cutter clamp blocks.

The shearing clamp block sections 236 and 238 are respectively urged away from the cavity block sections 240, 242 of the second shearing clamp block by means of compression spring assemblies 262, 264. Each assembly (FIGS. 11, 12 and 13) comprises a headed shaft 266 fixed at one end to one block and extending through the other block and through a spring housing 268 fixed to the other block. A compression spring 270 is mounted within the housing around the shaft 266, bearing at one end upon the outer end of the housing 268 and at the other end upon the remote end of the shaft in the other shearing clamping block section.

The inner clamp block 234 (sections 240, 242) is fixed to the slide 216 by means of a plate 217 that is fixed to the slide. A pair of shearing drive hydraulic motors 272, 274 are mounted on fixed bolsters 276, 278 that are fixedly connected to the plate 217. The motors comprise cylinders that carry driven piston rods 280, 282 mounting a blade drive yoke 284 that carries a blade drive rod 286 affixed to a driving block 288. Block 288 fixedly carries the blade 252. Mutually spaced microswitches 290 and 292 (FIGS. 10, 11) are mounted upon an arm 294 extending laterally from the plate 217 for actuation by a tongue 296, fixed to yoke 284, to stop the knife as it reaches its respective limiting positions.

Drive cylinders 272, 274 are operable to drive the yoke, and thus the blade 252, to cause it to move in the guide channels formed between the shearing clamp block sections, through the shearing clamp block assembly and across the mating cavities formed therein.

During all bending machine operations, but not the shearing operation, the shearing clamp assembly and the slide which carries both this assembly and the pressure die, are in a relatively retracted position, such as the position illustrated in FIG. 5. The slide and the pressure die may move forward from the start of bend position shown in FIG. 5 to a more forward position at the completion of a bend, but during this bending operation, the forward motion of the slide and pressure die is not sufficient to carry the rearward end of the pressure die past the bend die.

Figure 13:
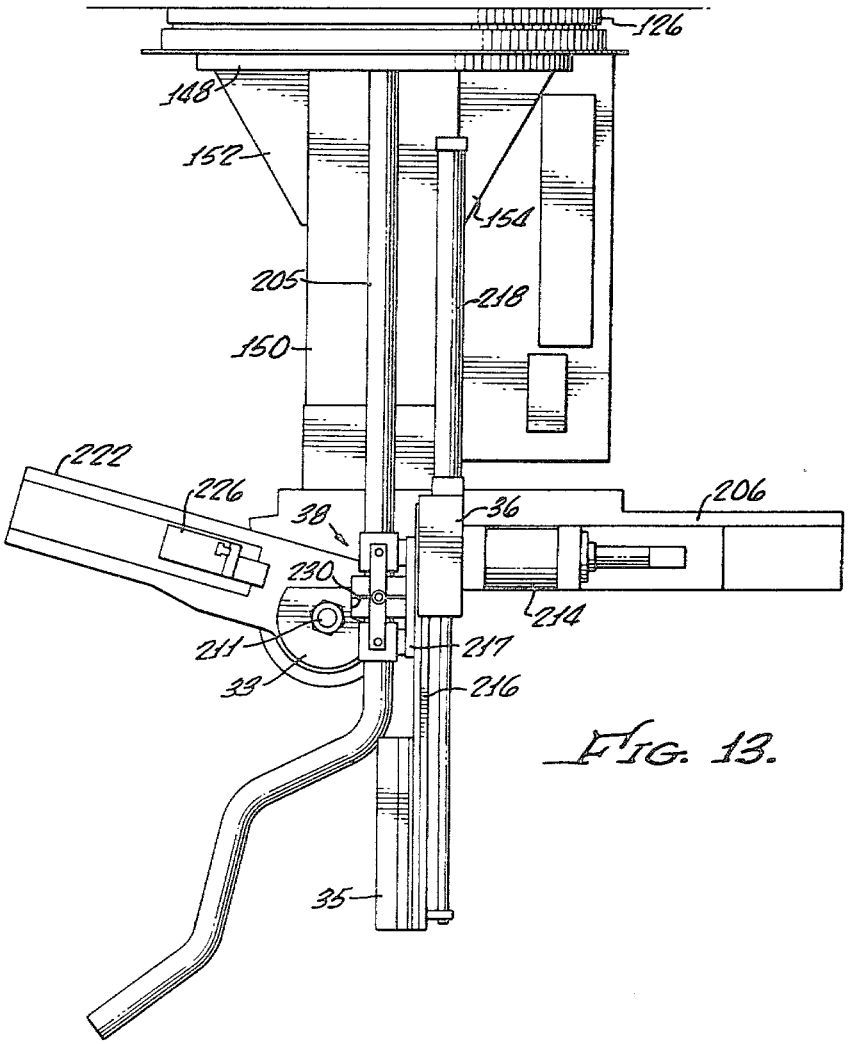
FIG. 13 illustrates the bending machine with the parts in position to shear a pipe that has been bent.

During the bending operation, the shearing clamp blocks are positioned relative to the pipe in the arrangement illustrated in FIG. 13 wherein shearing clamp block 234 (including section 242), which is fixed to plate 217, is relatively closely adjacent the pipe 205 whereas, because of the action of the spring assemblies 262, 264, the shearing clamp block 232 (including section 238) is spaced outwardly from the pipe. The pipe of course, can readily slide through the mating shearing clamp block cavities. The knife blade 252 is in a retracted position, as shown in FIG. 12 with its point extending through the sides of the shearing clamp blocks and guided within the channel between the block sections, but not far enough in to contact the pipe.

Upon completion of the last of a series of bends on a given pipe section, it is desired to sever the pipe section from the pipe in the feeding and forming stations. All of the pipe from the time it was formed has remained as an integral length of pipe. In fact, the pipe sections at the bend head are still integral with the strap stock on the stock roll 10. To sever the pipe, the bolster 36 is retracted, by operation of pressure die cylinder 214, and the slide 216 is moved forwardly, by operation of the booster cylinder 218, until it reaches the position illustrated in FIG. 13 wherein the shearing clamp assembly is directly opposite the retracted bolster 36. Before the shearing clamp assembly reaches its full forward position, the swinging bend arm assembly 222 is rotated through an angle of somewhat more than 180° until the bend die backup surface 230 is opposed to and adapted to be pressed against the outer surface of the shearing clamp block 232, as shown in FIGS. 10, 13 and 14. This positions the cut away bend die surface 230 opposite the bolster and thus provides adequate space to receive the shearing clamp assembly. Even with the bolster 36 (together with the slide and shearing clamp assembly) in retracted position, the width of the shearing clamp assembly is too great to fit between the slide and the circular bending surface of the bend die. To avoid interference between the shearing clamp assembly and the bend die and to avoid bending of the pipe by increasing bolster retraction, a portion of the bend die is cut away to provide the relatively displaced backup surface 230, as previously described.

The pressure die cylinder is operated to press the bolster toward the pipe, thereby firmly pressing the block 234 toward the bend die. Block 234 in turn presses the pipe 205 against block 232 which is then pressed against the bend die. The pipe 205 is thereby firmly clamped between the shearing clamp blocks by the opposing action of the bend die and the pressure die cylinder driven bolster. Pipe feeding is momentarily stopped and the pipe at the feeding and bending stations is motionless, even though the forming station continues to feed pipe to the storage loop. With the pipe firmly grasped between the clamp blocks, blade drive motors 272 and 274 are actuated to drive the blade through the clamp blocks and across the pipe receiving cavities thereof and, therefore, through a pipe received in these cavities. The blade completes its shearing motion in the position illustrated in FIG. 14. Thereafter, upon release of the pressure in the pressure die cylinder and retraction of the bolster, the severed bent pipe merely drops from the bend head to fall upon the conveyor.

Servo Control of Storage Loop

In order to enable substantially continuous operation of both the forming station and the bending station, the storage loop is servo controlled. The amount of pipe in storage is monitored and the relative rates of forming and bending are controlled to minimize, or at least decrease, changes in the amount of stored pipe. This could be achieved with an on/off or so-called "bang-bang" type of servo in which the slower of the forming and bending operations runs continuously and the faster operation runs intermittently. The latter runs until the amount of storage reaches a selected limit at which time it is stopped until the storage reaches another limit. For example, where the bending is carried out faster than the forming, the bending operation would be stopped, in such an on/off servo arrangement, when the amount of pipe in storage reaches a predetermined minimum (or not started until the minimum was exceeded). This condition would remain, with the forming of pipe continuing, until the amount of pipe in storage reaches a predetermined higher value, at which time bending operation would again start. Where the forming operation is faster than the bending operation, it would be the forming station that would be stopped when storage reaches a predetermined maximum and then started again when the storage reaches a predetermined minimum.

However, it may not be desirable to stop either operation. It is preferable to weld continuously. Further, it may be undesirable to stop a bending operation in the course of a given bend. Accordingly, a proportional type servo control of speed is employed in the illustrated embodiment. Since, as previously mentioned, the bending operation is faster than the forming operation in the described embodiment, the speed of the several bending steps is controlled in proportion to the amount of pipe in the storage loop. In the illustrated embodiment, the control is not directly and continuously proportional but the speed of the bending steps is varied in a plurality of discrete increments in accordance with the amount of stored pipe. The increments are sufficiently small so that the rate variation is effectively continuous and proportional to storage loop size.

Variation of the speed of the bending operation is controlled by simultaneously and synchronously varying the speeds of the three main bending drives, namely, the degree of bend (DOB) drive, the plane of bend (POB) drive, and the distance between bends (DBB) drive. The degree of bend drive is the rotational drive of the swinging bend arm assembly, which rotates the bend and clamp dies about the bend axis. This is an hydraulic motor shown in detail in the above identified co-pending applications Ser. Nos. 692,585 and 614,946, and broadly shown as DOB Drive Servo in FIGS. 15 and 16. The plane of bend drive is the motor 176 (FIG. 9) which drives the entire bending head about the vertical axis of the bearings that support the bend head from the overhead platform. The distance between bend drive is the motor 127 (FIG. 9) that drives the rollers of the feeder station.

As functionally illustrated in FIG. 15, the output of the storage loop detector 42 is fed in parallel to a DBB control 300, a POB control 302 and a DOB control 304. The DOB control is illustrated in block form within the dotted box and the POB and DBB controls are functionally identical thereto. DOB drive servo 306, which is a conventional servo-controlled hydraulic motor, is operated under control of a rate control circuit 308 and drives the swinging bend arm assembly, the rotational position of which is detected by a position pickoff (bend axis shaft position encoder) 310 physically located at the pivot shaft of the swinging assembly. Commanded position of the swinging bend arm assembly, namely, the number of degrees of commanded rotation, is derived from a position command circuit 312 and compared with the actual position in a comparator 314 to provide an output signal, when the two are equal, that is fed to the rate control circuit 308 to stop the drive. The speed of operation of the DOB drive is controlled via the rate control circuit 308 in response to a rate control signal from the storage loop detector 42. Similarly, the POB and DBB controls 302 and 300 have the speed thereof controlled by the same signal from the storage loop detector.

Thus, if the amount of pipe in the storage loop increases, an increased rate control signal is fed from the storage loop detector to the controls for each of the DOB, POB and DBB and these operations all proceed at an increased rate. If the amount of pipe in the storage loop should decrease, the signal from the detector commands a decreased rate of operation of the DOB, POB and DBB controls.

Figure 16:
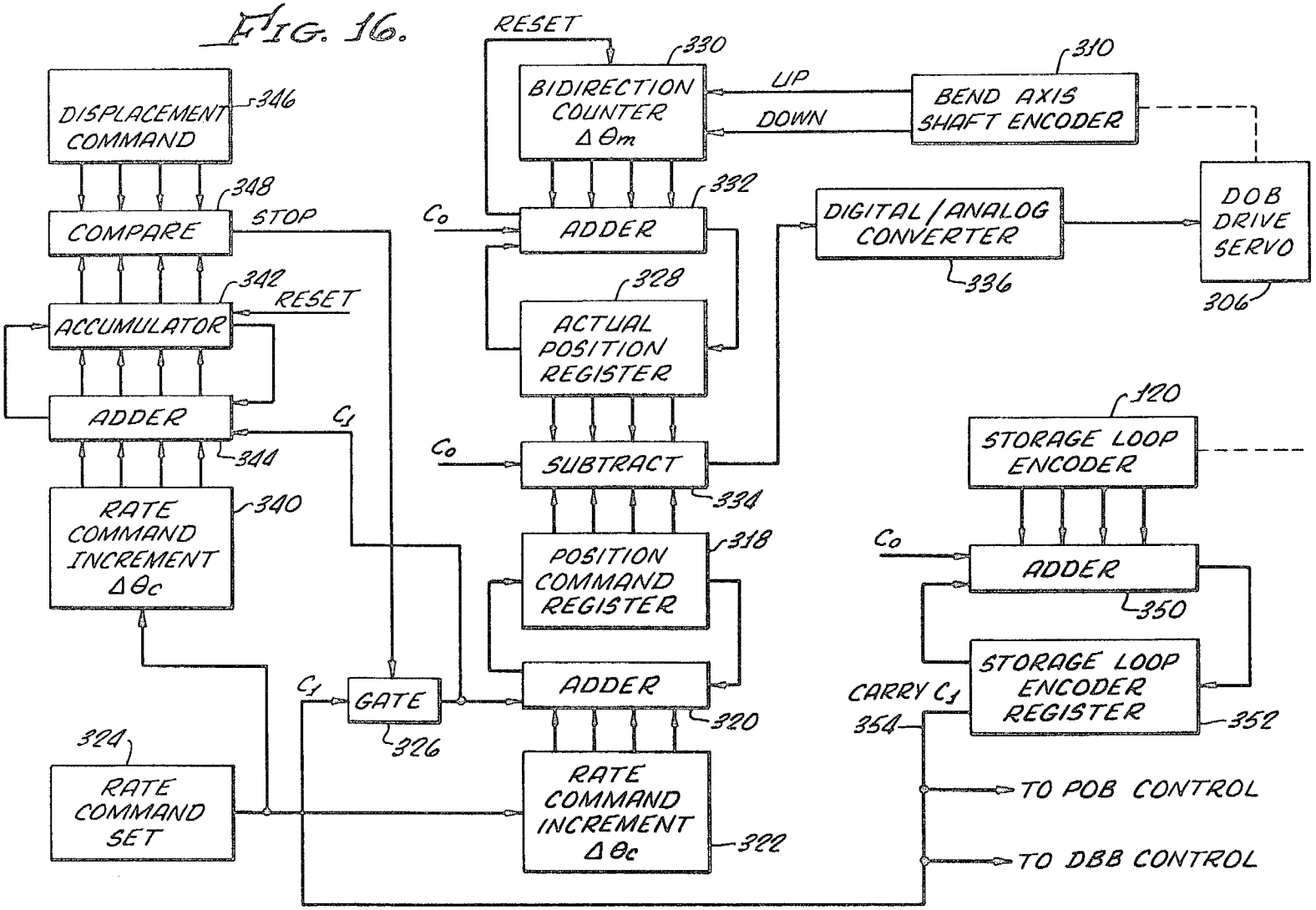
FIG. 16 shows details of an electrical speed control for bend die rotation.

Illustrated in FIG. 16 are further details of the degree of bend (DOB) control. The POB and DBB controls are functionally the same. There is provided a position command register 318 that stores a digital signal which is repetitively incremented, and which represents a commanded position of the swinging bend arm assembly shaft. The position command register is coupled to a command adder 320 that receives a rate command increment $\Delta\theta_c$ stored in a register 322. The number in the rate command increment register is set by a selectably controllable rate command set 324, which may be a manually operable control knob or knobs or a computer that controls machine operation. The adder is under control of a variable rate clock pulse $C_1$ that is fed thereto via a gate 326. Assuming the gate is open, upon each occurrence of the clock pulse $C_1$ the number in the position command register is augmented by the number stored in the rate command increment register, via the command adder 320. Therefore, the rate of change of the commanded position (e.g., commanded velocity) depends upon the magnitude of the rate command increment and the frequency of the clock pulses $C_1$.

Actual position is handled in a similar manner in that an actual position register 328 is connected with a bi-directional counter 330 by means of an actual position adder 332. The latter is operated under control of fixed rate clock pulses $C_o$ so that the number ($\Delta\theta_m$) contained in the counter 330 is added to the actual position register 328 upon each clock pulse $C_o$, and further, upon each clock pulse $C_o$ the counter 330 is reset.

The bi-directional counter 330 counts up or down. It counts up or down pulses provided from the bend axis shaft position encoder 310 that is connected to be rotated by the bend axis shaft. The counter 330 accumulates a number of pulses during bend axis shaft rotation and, upon each clock pulse $C_o$, adds the total of these to the number in the actual position register and resets itself. The number in register 328, therefore, is increased or decreased at each clock pulse $C_o$ by the number accumulated in the counter 330 between successive clock pulses. Thus, as the bend axis shaft rotates, the number in the actual position register changes in proportion to the shaft rotation.

The numbers in the actual position register and in the command position register are fed to a subtract circuit 334, also operated under control of the fixed clock pulses $C_o$, which determines the difference between the two numbers and sends this difference number to a digital analog converter 336 which, in turn, provides an analog output to the swinging bend arm shaft drive servo 306. The latter is conventional, including conventional electrical drive circuitry, a proportional servo value and an hydraulic drive cylinder.

The incremental number set into the rate command increment register 322 is also set into a second rate command increment register 340 and added to an accumulator 342 by means of a third adder 344 that is triggered by the variable rate clock pulses $C_1$. The total commanded displacement is the difference between the present position and the final desired position of the bend axis shaft. This may be a number representing 60°, for example, where the desired degree of bend is 60° and the present position is 0°. This number is set into a displacement command register 346 for comparison in a comparator 348 with the number in the accumulator 342. The accumulator is reset when the commanded displacement is set into command register 346. As the number in the accumulator is augmented upon each clock pulse $C_1$, it approaches the magnitude of the commanded displacement (that has been manually or otherwise set into register 346) and, when the two are equal, the comparator sends out a signal to close gate 326. This stops the variable clock pulse $C_1$ from actuating the command adder 320 (and also stops adder 344) and causes the number in position command register 318 to remain fixed. Therefore, when the number in actual position register 328 becomes equal to the now fixed number in command register 318, the difference is zero, the drive servo receives no further drive signals, and the rotation stops.

The variable rate clock pulse $C_1$ is generated in response to the storage loop detector 42 and, in effect, has a frequency that represents the amount of pipe in storage. The storage loop encoder 120 (FIG. 3), which is an absolute encoder, feeds a digital signal to a storage adder 350 (FIG. 16) under the control of the fixed clock pulses $C_o$. The number in the adder 350 is added to the number in a storage loop encoder register 352 which has a predetermined capacity. When the number in the register 352 has been increased several times, this register reaches its maximum capacity and overflows, generating a carry signal on a line 354. It is this carry signal, transmitted to and through gate 326 via line 354, that is the variable rate clock pulse $C_1$. The number of increments or the number of fixed rate clock pulses $C_o$ required to cause the register 352 to overflow, depends upon the magnitude of each increment. Magnitude of each increment (added to the number in the register 352 by means of the adder 350) is determined by the output of the encoder 120. Thus, if the output of the encoder is larger, each increment added to the register 352 is larger. Therefore, fewer increments are required to create the overflow and the repetition rate of variable rate clock pulses $C_1$ is higher. If the number from the encoder 120 is lower, each increment added to the number in the register 352 is smaller and thus more of such increments are required to cause the register to overflow. Thus a larger number of fixed rate clock pulses $C_o$ will occur between each variable rate clock pulse $C_1$. The number in the storage loop encoder 120 may be directly proportional to the size of the loop and therefore proportional to the amount of pipe in storage. Accordingly, the greater the amount of pipe in storage, the larger the number produced by the storage loop encoder and the higher the frequency of the variable clock pulse $C_1$. Conversely, the smaller the storage loop, the lower encoder number, and the lower the frequency of the variable clock pulse $C_1$.

The variable clock pulse $C_1$ is the rate control signal fed to each of the degree of bend, plane of bend, and distance between bend controls, as illustrated in FIG. 15. In the DOB control shown in FIG. 16, the variable rate clock pulse $C_1$ is fed via gate 326 to control the operation of the position adder 320. Accordingly, the higher the frequency of $C_1$, the faster the position command register 318 is incremented, and therefore the faster the number in the register 318 will change. The rate of change of the number in the position command register is, of course, the rate of rotation of the bend axis shaft which is driven by this control.

The POB and DBB controls are identical to the described degree of bend control, except of course that the latter employ electrical driving motors rather than hydraulic driving motors. The bend axis shaft position encoder 310, the feed encoder 147, and the bend head rotation position encoder 183 are sequential incremental encoders 25 GL-36 OID-PAD-15/S, made by Sequential Information Systems, Inc. of New York, N.Y. These produce electrical pulses for each increment of input shaft rotation. The loop detector encoder 120 is a sequential absolute encoder 25 H-8CB-B-1, made by the same manufacturer and provides a multiple bit digital signal that represents an absolute position of its input shaft rotation.

Although the variation in the storage loop is employed to control frequency of clock $C_1$, to thereby control the drive rate, the number in the rate command increment register 322 could also be controlled to vary such number. This is so because the larger the increment in this register, the faster the number in the position command register 318 will be increased at a given clock rate, and the smaller the number in the rate command increment register 322, the smaller the rate at which the number in register 318 is increased. Thus the output of the storage loop encoder could alternatively be employed to vary the number in the rate command increment register 322 in order to control drive rate, while maintaining a fixed clock rate into the adder 320.

As previously described, for a combined compression and draw bend operation a bend is started without applying substantial axial tension to the pipe, but is completed while the pipe is being stretched (at the outside of the bend) beyond its yield. This type of bending is described in detail in the above-identified co-pending applications Ser. No. 692,585 and Ser. No. 614,946. In the prior methods and apparatus, the pipe is advanced for distance between bends by a carriage that is unrestrained during bend die rotation. Axial tension is applied to the pipe by the pressure die which presses the pipe against the bend die with increasing pressure to provide a "wiping" action as the pipe slides past the pressure die. The methods of the prior applications also employ the pressure die to grasp the pipe (pressing it against the bend die) so that the pipe does not move relative to the pressure die. Axial tension is applied by restraining forward motion of the pressure die.

However, in the system described herein, the pressure die need not be used to create tension in the pipe since the feed rollers firmly grip the pipe and can be controlled to advance the pipe at a desired rate. Such combined compression and draw bending is accomplished in the present system in the following manner. The bend die rotation rate and the feed rate initially have a fixed relation so that the pipe is pulled around the bend die at the same speed that the pipe is advanced by the feed station. To achieve elongation of a pipe, it is necessary to pull the pipe around the bend die at a rate faster than it is fed from the feeding station. This can be accomplished by either increasing the rate of rotation of the swinging bend arm assembly, or decreasing the rate of pipe feed, or a combination of the two. Since, in the illustrated embodiment, the bend axis is rotated at or near its maximum speed, pipe elongation or drawing is achieved by slowing down the feed rate. Thus, the rate command set of the DBB, or feed roller drive, which corresponds to rate command set 324 of the DOB control of FIG. 16, is conveniently arranged to operate in a two-step arrangement. For example, if an increment in the rate command increment register (corresponding to register 322) that commands an advance of the pipe of a certain number of units for each clock pulse will cause pipe to advance from the feeding station at a rate exactly equal to the rate at which it is pulled around the bend die, the magnitude of the increment may be decreased by about 3 to 10%. The increment is changed at the point in the bend die rotation at which drawing is to be commenced. In general, compression bending (without applying a tension beyond yield strength) occurs for the first 20° of a bend and the remainder of the bend is carried out while axially restraining the pipe beyond its yield strength to effect drawing. Preferably, the rate of pipe advance from the feeding station during such drawing is in the order of 90% to 97% of the rate at which the pipe is pulled around the bend die. The magnitude of the increment may be changed by manually controlling the rate command set of the DBB control or it may be achieved automatically by sensing the amount of bend die rotation and decreasing the number in the rate command increment register when a predetermined value, such as 20° bend die rotation, has been achieved. Although a two-level value is presently employed for the rate command increment of the DBB control, it will be readily appreciated that feed rate may be decreased in a series of discrete steps or a continuous function rather than in a single step function, as deemed necessary or desirable.

As a typical, but not limiting, example of the relative rates of bending and feeding for combined compression and draw bending on a four inch bend die radius, consider a bend control operable to provide eight units of bend die rotation for each clock pulse, where the clock pulses occur at 4 millisecond intervals. If each unit is 0.05 degrees, this provides a bend rotation rate of 0.278 revolutions per second.

The feed rate command increment is set so that each clock pulse of the same train of clock pulses provides 11.18 units of pipe advance, each unit being 0.0025 inches. This provides a linear feed rate of 6.98 inches per second. Thus the feed rate control is set to provide, in this example, 11.18 units of motion per clock pulse for the first twenty degrees of bend angle. After the first twenty degrees of bend angle, the feed rate command increment is set to provide only 10.28 units of lineal motion of the pipe per clock pulse which thus provides a feed rate of 6.425 inches per second. Therefore, for the first twenty degrees of motion, the ratio of the linear travel of the feed rate to the linear travel of the pipe around the periphery of the bend die is $$\frac{6.988 \text{ in/sec}}{.278 \text{ rev/sec} \times 2\pi \times 4 \text{ in.}} = 1.00$$

(for a bend die of 4 inch radius). The two rates are equal and no stretch occurs.

After the first twenty degrees, the ratio of feed rate to bend rate is $$\frac{6.425}{(.278) \times (2\pi) \times (4)} = .92$$

indicating a stretch of 8% since the linear travel from the feeding station is only 92% of the linear travel of the pipe around the bend die. Thus for the combined compression draw bending, bend rate remains constant in this example, at 0.278 revolutions per second, and feed rate control provides a pipe advance of 6.98 inches per second for the first twenty degrees of bend and a pipe advance rate of 6.425 inches per second for the remainder of the bend, during which the pipe is elongated.

Although, for many types of bending, it is preferred to control the feeding station rate to provide the required amount of pipe stretch without employing drag produced by the pressure die, it is also contemplated that both types of stretch may be employed if large amounts of tension are required. Thus the pressure die may be operated to provide a frictional drag in the manner described in the above-mentioned patent applications and, at the same time, feed rate may be decreased to provide additional drag.

The described speed controls can be operated under manual control to manually input the several command numbers or increments by means of dials, switches, or the like. However, in a presently preferred embodiment, the apparatus is under computer control and the several DOB, POB and DBB controls, in addition to many of the other machine functions, are operated and appropriate functions are formed by the computer itself. Thus, with respect to the degree of bend control of FIG. 16, all of the blocks other than the bidirectional counter, the encoders, the drive servo, and the digital analog converter, may be within the computer and, moverover, may be controlled by suitable computer software, as will be readily understood by those skilled in the art.

Modified Pipe Storage

Although it is preferred to compensate for differences in the rates of the preferably continuous pipe forming and the rates of the generally intermittent pipe bending by varying the quantity of pipe storage between relatively fixed bending and forming stations, it is also contemplated to mount one of the stations, such as the forming station (together with its stock roll 10) on tracks (not shown) and positioned initially at a relatively long distance from the storage detector 42 (which in this case would merely be a fixed pipe guide sine no storage variation need be detected in this arrangement). Thus, as the feeder 28 feeds pipe to the bending machine at a rate faster than the pipe is formed, the entire forming machine will be drawn along the rails and along the storage path of the intermediate pipe portion. When the forming means has advanced a certain distance, a suitable forming station position detector will temporarily stop operation of the bending so that as the pipe continues to be formed, the forming station will then be returned to its initial and remote position. This arrangement would employ a forming station of sufficiently low inertia as to follow variations in bending speed. Motion of the forming station could be assisted by suitable motors, or a curved pipe path could also be employed to accommodate rate differences that occur at faster rates.

Figure 17:
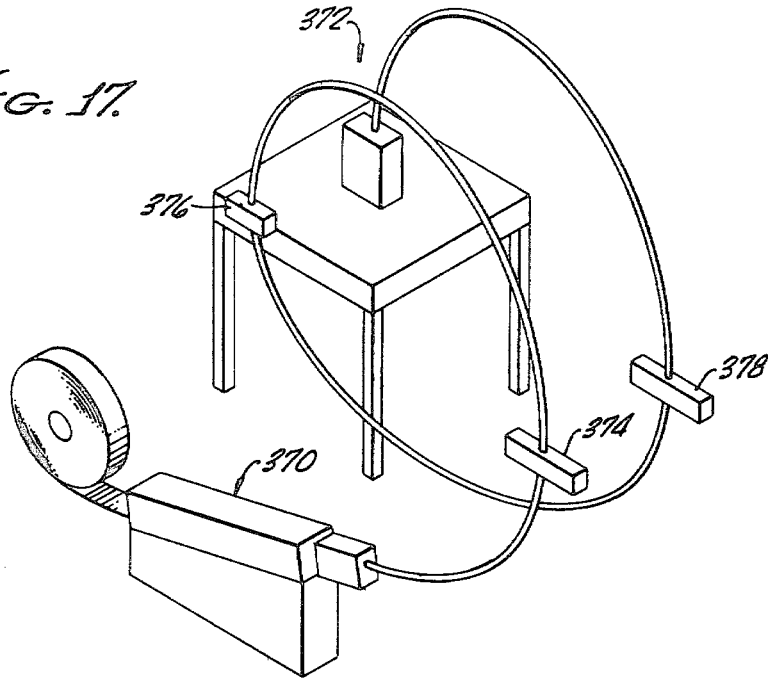
FIG. 17 is a pictorial illustration of a system with a modified storage loop.
Figure 18:
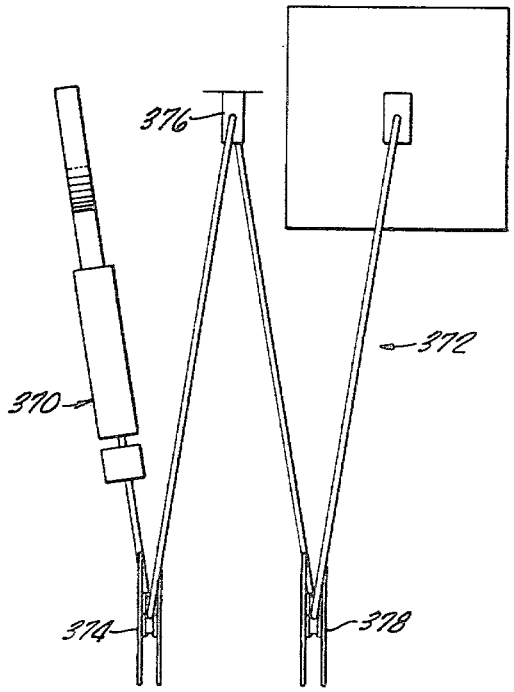
FIG. 18 is a top plan view of the system of FIG. 17.

Still other arrangements for storing pipe between the pipe supply station and the pipe bending station are contemplated. The pipe may be caused to follow any one of a number of different paths between the supply and bending stations. The paths may be of many lengths and configurations and even can accomplish transport of the pipe (before it is cut) to a remote location (as described below and shown in FIG. 23). The single loop previously described may be of any suitable diameter, it may be planar or non-planar (that is, the supply station may be laterally displaced from the bending station and may have plural bends in different planes). The storage also may be provided in a multiple loop path, as illustrated in FIGS. 17 and 18, for example, wherein the major stations are shown schematically. As illustrated in FIGS. 17 and 18, the supply station, generally indicated at 370, may be identical to that described earlier and illustrated in FIG. 1. Similarly the feeding and bending stations, generallyindicated at 372, will also be identical to those described earlier. In this embodiment, the pipe, as it leaves the supply station, is passed through a spiral path formed by a pluraliy of loops. The length of the spiral, as measured along the axis of the spiral (and as distinguished from the length of the pipe in the spiral) is held fixed and the diameter of one or more of the loops in the spiral is allowed to vary and is measured in order to detect the amount of pipe in storage. Thus pipe leaving the supply station 370 is passed through a first schematically shown detector 374 which may be identical to the detector 42 previously described, and thence through a set of fixed guide rollers 376 on a first loop. The pipe loop then continues through a second movable set of rollers, which may take the form of a second detector 378, and thence is fed to the feeding and bending station 372. In this arrangement, one side of the spiral, the side at which the fixed guide rollers 376 and the feeding and bending station 372 are positioned, is fixed and the other side of the multiple loop pipe spiral is shiftably guided by the rollers of the detectors 374, 378, being shiftable in a generally radial direction of the loops. One or both of the detectors 374, 378 is employed to produce a signal representing the diameter of the coils of this spiral loop. The detector signals thus represent the amount of pipe in the loop and such signals are employed, as previously described, to minimize the difference in the rate of withdrawing pipe from the supply station and the bending rate. Many other variable length pipe storage arrangements will be apparent to those skilled in the art. The arrangements disclosed herein are merely exemplary, but not limiting.

Modified Supply Station

Figure 19:
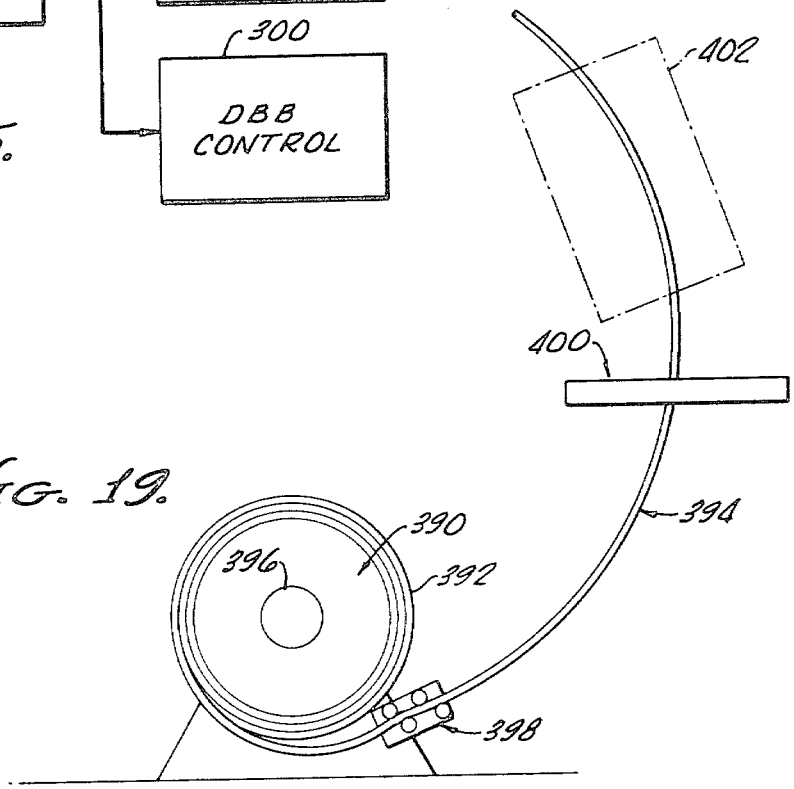
FIG. 19 illustrates a pipe supply station in which pre-formed pipe is withdrawn from a pipe storage drum.

In some situations it may be desirable to perform the pipe forming at a different time or facility than the pipe bending. In such a case, the simplified bending system described herein may employ a supply station that does not form or weld the pipe, but which merely comprises a roll of preformed or premanufactured pipe of a suitable long length. Preferably, such a long length would be stored upon a drum. thus pipe may be preformed in straight sections and then the sections butt welded in end-to-end relation to provide a substantially continuous or very long length of pipe. Such long length of pipe is then wound or coiled upon a pipe storage drum 390 as illustrated in FIG. 19. Alternatively, the pipe could be wound on the drum as it is formed. The drum, which is rotatably mounted, has a relatively large diameter, suitable to the curvature required for coiling the pipe without buckling, although ovalling or flattening of the pipe will enable storage on smaller diameter drums. The pipe storage drum 390 stores a substantially continuous length (actually a long finite length) of coiled pipe 392 thereon and is positioned at the start of the storage loop, generally indicated at 394 in FIG. 19. The pipe is withdrawn from the storage loop either under the action of the feeder station as previously described or under the action of a motor 396 that rotates the drum to supply a continuous run of pipe therefrom at a selected and preferably constant speed. If the drum diameter is significantly less than the diameter of the storage loop 394, a series of rollers 398 is provided to partially straighten the pipe and make the curvature of the pipe withdrawn from the drum more closely conformed to the average curvature of the storage loop 394. It will be apparent that the pipe may be withdrawn from the drum by driving any one of the straightening rollers 398 instead of driving the drum itself.

The storage loop 392 includes a detector 400 which may be identical to the detector 42 illustrated in FIG. 1. A storage loop of variable length is required in this case, even though a supply drum having a length of rolled pipe thereon is employed instead of the previously described pipe or tube mill, because of inertia of the storage drum 390. Theoretically, pipe can be withdrawn from the drum 390 at any desired speed and thus the rate of pipe withdrawal could be caused to closely follow the rate of pipe utilization. However, the pipe supply station is a large mass, the drum being in the order of ten to twenty feet in diameter and capable of storing many coils of pipe thereon. Therefore the drum has a large amount of inertia and impractically large motors and brakes would be required to achieve appropriate variation of pipe withdrawal rate from such a drum in order to match the intermittent and variable bending rates. Accordingly, the storage loop 394 is employed in the same manner as is the equivalent loop previously described. The output of detector 400 is caused to control the bending rate and feed rate so as to minimize changes in the amount of pipe stored, while the pipe is withdrawn from the supply station 390 at a fixed rate.

The ability to employ frozen or solidifiable material as a mandrel is an additional unique and surprising result afforded by the described system. When one tries to bend relatively shot lengths of pipe that are filled with ice, it is necessary first to plug both ends of the pipe to retain the water as it is being frozen. This is an additional and undesirable step to be performed on each pipe section. Further, when the pipe is bent, its cross section is diminished and the ice will be sequeezed and forced out of the pipe toward the rear through the as yet unbent section. For reasons such as these it has not been practical heretofore to employ a solidifiable material as a mandrel. With the present system, wherein an effectively limitless or at least very long length of continuous pipe is employed, the solidified material will not be forced out of the pipe toward the rear during the bending action since such material must travel a relatively long distance through at least part of the length of the storage loop or through the entire length of the pipe coiled on the supply drum, depending upon where the material is solidified.

For use of a frozen or otherwise solidifiable material as a mandrel, it is contemplated that a very long, but finite, length of pipe be employed, such as the supply station of FIG. 19. Thus, with the supply station in the form of a roll of pipe coiled upon a drum, the rearmost end of the pipe on the drum can be employed as a liquid input to fill the entire interior of the coiled pipe. Because expansion of the solidifiable material is restrained by the long length of pipe that is filled with such material, if water is employed to be frozen as a mandrel, the water contains a quantity of compressible particles such as styrofoam pellets, for example, to allow expansion upon freezing, without bursting the pipe. A freezing chamber 402 (employing liquid nitrogen, for example) is positioned at any suitable point on the storage loop. As the pipe traverses the curved storage path, it passes through the freezing station and the compressible pellet laden water will be frozen within the pipe. After completion of bending and severing of a pipe section, the solidifiable material is readily liquified or otherwise removed and if desired, recovered for reuse.

Modified Cutting Action

In the cutting action previously described, at the end of the last bend on a particular section of pipe the swingable cutting arm is rotated until the cut away portion of the bend die is properly positioned. Thereafter, the cut is made and the swingable arm is returned to a starting position for the next bend. This is a relatively time-consuming operation, requiring as much as five seconds at a typical machine speed. To minimize the delay required by this type of cutting operation, the arrangement illustrated in FIGS. 20 and 21 may be employed. In this arrangement, instead of cutting away a part of a bend die in order to provide sufficient space to receive the shearing clamp block assembly between the bend die and the pressure die bolster, the entire bend head is laterally shifted by a small amount relative to the pipe axis. Thus the shearing action may be performed immediately after the completion of the final end. This cutting may be performed with the bend die in any position it may assume at the termination of such final bend. No time is required for further rotation of the bend die to a unique cutting position and no time is required to rotate the end die back from such a unique cutting position.

Figure 20:
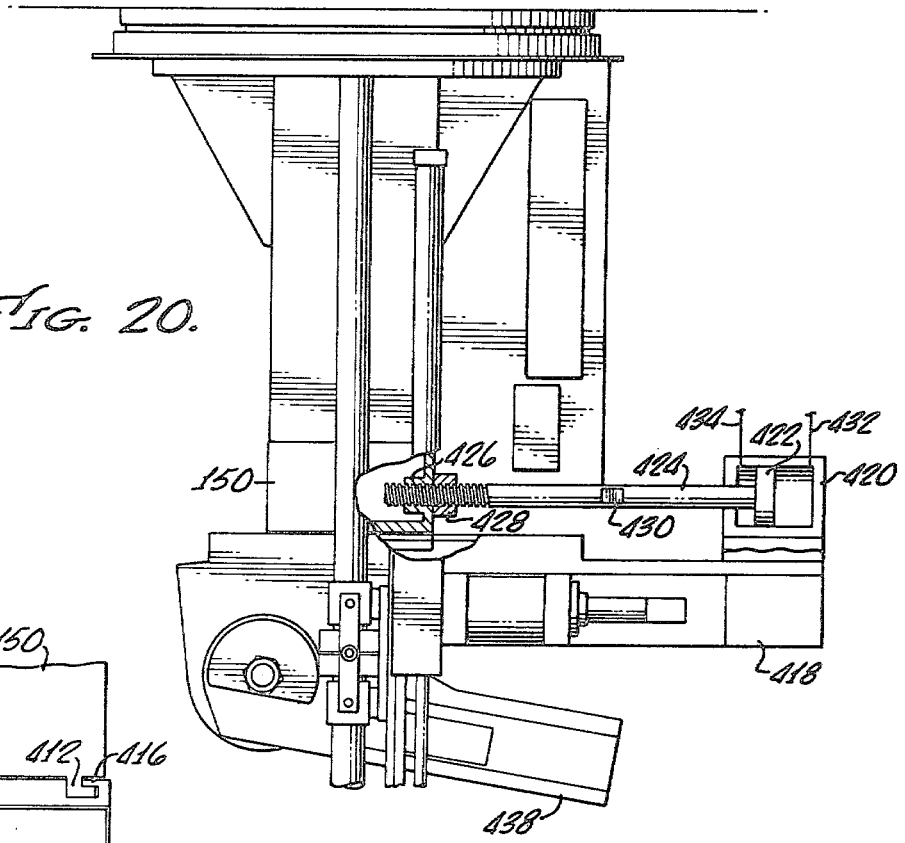
FIGS. 20 and 21 show a modified pipe shearing arrangement in which the bend head is laterally shifted for clearance without rotation of the bend die.
Figure 21:
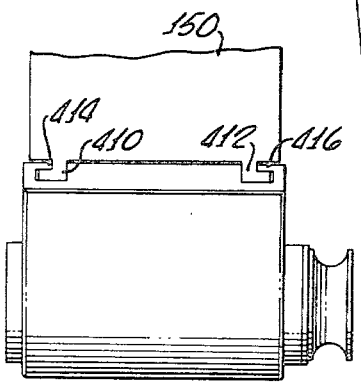

As shown in FIGS. 20 and 21, the entire bend head is slidably mounted on the machine bed or support column 150 (see also FIG. 5) for motion in a direction perpendicular to the direction of advancement of the pipe from the pipe feeding station. The support column 150 carries a pair of mutually spaced depending L-shaped tracks 410, 412 which form outwardly facing guide channels that slidably receive and interengage with mutually spaced inwardly facing guide channels 414, 416 that are fixed to the upper surface of the stationary arm assembly 418 of the bend head. The entire swinging arm assembly is mounted on the stationary arm assembly for rotation about the bend die axis. Remotely controlled lateral positioning of the stationary arm assembly 418 (and thus of the entire bend head) is achieved by means of an hydraulic motor comprising prising a cylinder 420 fixedly carried on the stationary arm assembly 418 and mounting a piston 422 having a piston rod 424 which is threaded at one end into an internally threaded bracket 426 fixed to the support column 150. A suitable lock nut 428 is provided to lock the piston rod 424 against rotation in the threaded bracket 426. A tool receiving surface, such as a wrench receiving flat 430, is formed on the piston rod for rotation of the latter when a fine threaded adjustment is required and after the lock nut 428 is loosened. The piston and cylinder 420, 422 are controlled by pressure supplied via hydraulic lines 432, 434. The bend head is laterally positioned for the bending operation in the position described with respect to FIG. 5. The swinging bend arm assembly 438 carries the bend and clamp dies just as previously described, and the fixed bend arm assembly carries the pressure die, bolster, the slide and the shearing clamp assembly, all as previously described. Upon completion of the final bend, the swinging arm assembly 438 remains in its final position of rotation and the slide, which carries the shearing clamp assembly, is moved forwardly to advance the shearing clamp assembly toward the bend die. Concurrently the pressure die bolster is retracted by a greater than normal amount to provide clearance for the shearing clamp blocks and the cylinder 420 is pressurized. This pressurization drives the fixed arm assembly 418 toward the left, as viewed in FIG. 20, thereby avoiding undue bending of the pipe which would otherwise be caused by the shifting of the bolster and the clamp blocks. The shearing assembly assumes the position illustrated in FIG. 13, except that the swinging arm assembly has not been rotated to the extreme position of FIG. 13, and it is the circular portion of the bend die which is now pressed against the shearing clamp blocks as a backup.

The shifting of the entire bend head to the left, as viewed in FIG. 20, is preferred to merely additionally shift the pressure die bolster to the right because the additional outward shifting of the pressure die bolster, carrying the pipe guiding shearing clamp blocks therewith, would bend the pipe outwardly to an unacceptable degree and thus would create an undesirable bend in the pipe. The described arrangement, wherein the pressure die bolster is retracted through a greater than normal extent and the entire bend head is laterally shifted relative to the pipe, enables the pipe, between the feeding station and the bend die, to remain substantially straight for the shearing action. This eliminates the time required for swinging the entire rotating bend arm assembly as in the cutting method previously described. In addition, of course, the bend die need not be cut away to provide the additional clearance.

The described shearing assembly is merely exemplary of many types of cutting systems that may be employed. For some types of operations and particularly for pipe made of harder material having a higher modulus of elasticity, a rotary type cutting operation, instead of a shearing operation, may be employed with any of the described cutting actions. Thus a rotary cutter would include a plurality of inwardly directed and radially shiftable chisels positioned and mounted to rotate around the pipe under a suitable rotary drive. Such chisels remove material from a narrow circumferential band in a lathe type cutting action. In some respects this is a preferred mode of cutting since there is less upset of material than in shearing and material is removed by the cutting action of the chisel rather than simply displaced. Such a rotary cutting may be initiated at a portion of the pipe considerably to the rear of the bending dies, at a point adjacent the feed station, before the pipe is bent. In such a case, the circumferential groove would not be cut all the way through the pipe—the pipe groove would have a depth in the order of two-thirds of the wall thickness of the pipe. This allows the pipe to be handled as if it were uncut, being further advanced toward the bend dies, being bent, and then again advanced. After the final bend, the pipe is advanced to allow the partially cut section to project beyond the bending dies so that mere swinging of the bend head, together with the inertia of the pipe section, would simply snap the pipe section off at the partially severed cut. A resilient bumper or the like is mounted adjacent the machine so that rotation of the bend head would swing the pipe against the bumper and insure the final severing of the partially cut portion.

Anti-Twist Tube Mill

Figure 22:
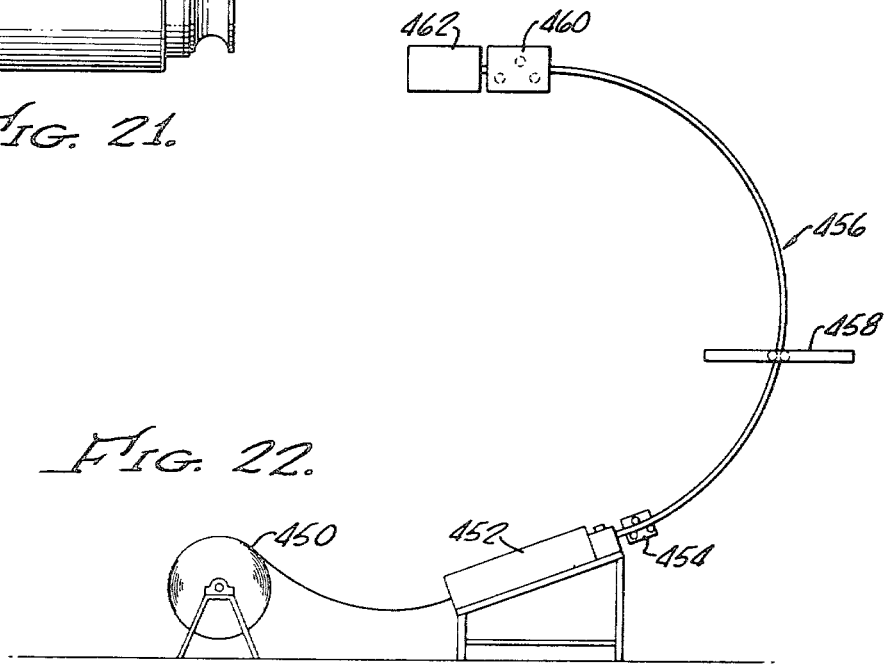
FIG. 22 shows a simplified tube mill having pipe twist control.

As previously mentioned, the storage loop provides the surprising and unexpected result of effectively eliminating pipe twist. Thus a simplified tube mill, without a bending station, may be provided, employing a stabilized loop to prevent twisting and to provide air cooling, regardless of whether or not the pipe is to be bent or otherwise handled after it is formed. A simplified anti-twist tube mill embodying principles of the present invention is substantially identical to the tube mill illustrated in FIG. 1 except that it employs a tube cutter at the output end of the stabilized loop instead of the feeding and bending stations previously described. As illustrated in FIG. 22, such a simplified mill comprises a supply roll of flat stock 450 feeding into a tube forming and welding station 452 with a plurality of curving rollers 454 at the output of the forming station, all constructed and arranged as previously described in connection with the forming station of FIG. 1. Just as previously described, the pipe leaves the curving rollers 454 to follow the non-linear path of the stablized loop, generally indicated at 456, and passes between a pair of guide rollers, generally indicated at 458. These rollers may be fixed rather than movable as in the detector of FIG. 1 since it may not be necessary in an arrangement for merely forming to have a variable length loop, nor would it be necessary to detect length of the loop. From the guide rollers 458 the pipe continues in its curved path to a plurality of straightening rollers 460 and thence to a cutting station 462 at which desired sections of the straight pipe are severed. As previously described, the loop need not be planar and, in the arrangement of FIG. 22, it is preferable that the forming and curving stations 452 and 454 be laterally displaced from the straightening and cutting stations 460 and 462 whereby pipe may merely drop vertically from the cutting station into a suitable storage area or conveyor.

Pipe Transporting Tube Mill

Figure 23:
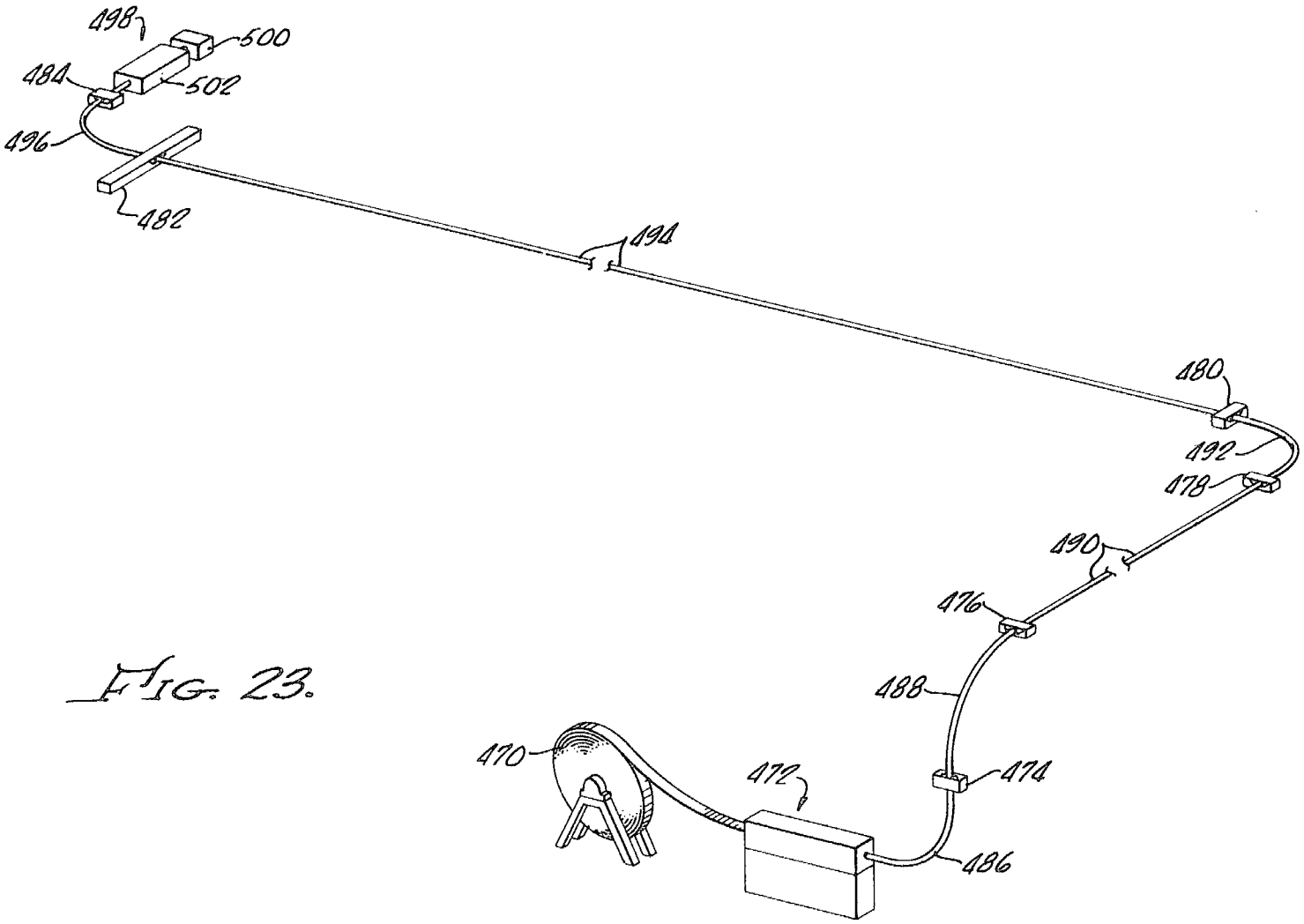
FIG. 23 shows a modified tube mill for both forming and transporting pipe.

Still another form of simplified tube mill, embodying a pipe transporting function, is illustrated in FIG. 23. In many presently existing facilities, a tube mill, positioned at one part of a plant, makes a number of straight lengths of pipe which are then collected, stacked on a vehicle, and transported to another part of the same plant, or to an adjoining building, for utilization. For example, pipe is formed at one part of a large plant, stacked and carried to another part of the plant at which a plurality of conventional pipe bending machines are located. The pipe is then loaded on such bending machine for individual bending. Employing principles of the present invention, much of the pipe handling is eliminated by simple modification of the existing tube mill. Thus, as illustrated in FIG. 23, a supply roll of flat stock 470 is fed to a tube forming and welding station 472, all constructed and arranged as previously described in connection with the forming station of FIG. 1. However, in this forming station, neither pipe straightening rollers nor pipe curving rollers are provided at or adjacent the forming station.

Fixedly mounted at selected points placed along a predetermined and generally non-linear path from the pipe forming station to a location in the plant at which the pipe is to be utilized, are a plurality of pipe positioning roller guides 474, 476, 478, 480, and 484. The continuous run of finished pipe leaving the forming station 472 is constrained to pass through these roller guides and therefore is constrained to pass along the predetermined path which, of course, may be of many different lengths and configurations. In the exemplary pipe path illustrated in FIG. 23, solely for purposes of exposition, the pipe first curves upwardly via a ninety degree bend 486 for a distance of about ten feet to the guides 474, then bends to the left via a curve 488 and thence passes through guides 476 for a straight run 490 which may have a length of fifty feet, for example. The pipe path then makes a second ninety degree left hand turn 492, being constrained in this turn by guide rollers 478 and 480, and then passes along a relatively straight run 494 (which may have a length of two hundred feet, for example) to a right hand turn 496 that is guided and defined by roller guides 482 and 484.

The terminal station of this pipe transporting tube mill, generally indicated at 498, includes a pipe cut-off assembly 500 which may be of any conventional type and which may be preceded, if deemed necessary or desirable, by a series of rollers 502 which may perform a straightening and/or a pipe driving function. It will be seen that the first curve 486 raises the path of the finished pipe so that the remainder of the path will lie overhead in a normal plant facility, causing minimal interference with usual plant activities. The remainder of the path is illustrated as lying in a substantially horizontal plane although as will be readily appreciated, this path can take many other desired forms and lengths, making other turns to the right or left, and moving upwardly or downwardly as may be convenient and compatible with existing facilities and equipment.

The curvature of the pipe path accommodates differences in the rate of pipe motion at different points along the path, whether these differences are due to different rates of operation at the forming and terminal stations or merely due to temporary variations in friction or other resistance to pipe motion at various points along the path.

In the arrangement described in FIG. 23, the bends 486, 488, 492 and 496 are illustrated as being ninety degree bends, but it is contemplated that other angles of these pipe path turns may be employed as deemed necessary or desirable. Further, each of these bends comprises a pipe loop having a sufficiently large diameter so that the pipe can conform to the loop curvature without being stressed beyond its yield point. Thus no curving rollers are employed or required and it is primarily the constrant of the several guide rollers that causes the pipe to assume the curvature of the several loops 486, 488, 492 and 496. Similarly, curving rollers may be omitted from the previously described forming stations. However, since some undesirable bends may axist in the pipe, either due to the forming process itself or the relatively long transport of the pipe, the straightening rollers 502 are employed to insure that the output pipe sections are indeed straight.

The driving force of the rollers of the forming station 472 provides sufficient longitudinal drive of the pipe to move the pipe along a path of several hundred feet so that no additional forces are normally required to transport the finished pipe along the described sinuous path to the output station 498. However, it will be readily appreciated that the straightening rollers 502 may be power driven to assist in moving the pipe along the curved path or additional friction drives may be positioned at one or more locations along the sinuous pipe transporting path if longer paths are employed.

If deemed necessary or desirable, one or more of the various roller guides, such as roller guides 458 of FIG. 22, or roller guides 474, 476, 478, 480, 482, 484 of FIG. 23, may be made in the form of loop position detectors, like detector 42 of FIG. 1, and the output of such detector may be employed to control either the rate of the forming station or the rate of drive of the feed or straightening rollers at the terminal station in order to minimize variations in the length of pipe stored in the curved path between the forming and terminal stations.

Sections of pipe cut off at the terminal station 498 of FIG. 23 are positioned at or closely adjacent the point of use and may be thus directly or otherwise supplied to the pipe using apparatus which, as previously mentioned, may be one or more conventional pipe bending machines.

Static Pipe Cut Off

When used in a simplified tube mill, such as the mill of FIGS. 22 or 23, the loop or non-linear path of the path provides still another unexpected advantage, in addition to its storage function of the system of FIG. 1, its cooling function, its anti-twist function, and its transport function. This additional function is the ability of the simplified tube mill system to employ a static pipe cut-off in the place of the conventional dynamic pipe cut-off. It should be noted that a static cut off is employed in the system of FIG. 1 since the pipe and cut off assembly are both momentarily stopped during cut off, while clamped between the bend die and the pressure die bolster.

In prior tube mills, the finished pipe follows a straight and relatively short path to the cut-off station. The mill continuously manufactures pipe at relatively high rates, often at a rate as much as three hundred feet per minute. In such prior mills, the cutting assembly must move with the pipe since longitudinal motion of the pipe is continuous at the high rate of pipe forming. Thus it is common to provide a dynamic pipe cutter which is repeatedly accelerated to cause it to move along the pipe at the speed of pipe motion, to lock it to the pipe at the selected cut-off position within a desired tolerance, often in the order of one thirty-second of an inch. The cutter is then released from the pipe, returned (moved longitudinally back toward the tube mill) and then once again forwardly accelerated to move it at pipe speed to the position of the next cut. All of this is done while the pipe is moving at the forming rate.

With a tube mill such as that shown in FIG. 22 or FIG. 23, for example, the cutter assembly need not move. A static cutter assembly may be employed and, when a point on the pipe at which a cut is to be made moves to the blade of the cutter, the motion of a forward portion of the pipe at the cutting station, but only at the cutting station, is stopped and the cutter blade shears a motionless pipe section. Upon completion of the cut, the pipe is released and the forward portion of the pipe at the cutting station may continue its motion.

Stopping of the pipe and cutting it may require a total time of approximately one second. During this time, even at a rate of three hundred feet per minute, five feet of pipe are formed at the continuously operating forming station. Thus the storage loop will increase in length by five feet in the one second during which the motion of the forward portion of the pipe at the cutting station is stopped. As previously described, the curved storage loop will readily accommodate variations in the amount of pipe stored therein of these and considerably greater magnitudes. When the pipe is released from the locking imposed by the cutting station, the inherent resiliency of the pipe in the curved storage loop which changes its curvature as its length increases, will tend to bring the storage loop back to its steady state (between cutting intervals) form. Thus the forward portion of the pipe may be resiliently driven through the cutting station at a faster rate for an initial period immediately following release of the pipe at the cutting station.

The motion of the pipe may be stopped at the cutting station either by actuation of the cutter assembly clamps or by the control of feed or straightening rollers, such as the rollers generally indicated at 460 in FIG. 22 or 502 in FIG. 23. These rollers which tightly grasp the pipe for straightening and/or driving may be stopped to stop the pipe motion. If deemed necessary or desirable, an additional brake (not shown) may be employed to firmly grasp the pipe and momentarily stop its motion at the cutting station for the required relatively short cutting period.

The static cutter may be of any desired configuration and may comprise a cutter of the type illustrated in FIGS. 10, 11, 12 and 14. Such a cutter, of course, would be provided with a fixed backup plate that would perform the function of the bend die 33 and would be suitably mounted to have its clamp blocks driven into clamping engagement with the pipe by means of an hydraulic motor, such as the pressure die cylinder 214, or equivalent power device. Other types of cutters may be employed, including a type known as the Crieder cutter, in which a small portion of the pipe wall is cut through or nearly through by an initial tangential cut, and then a shearing cutter, similar to that shown in FIG. 11, is passed through and across the pipe with its point entering the initial cut in the pipe wall. This type of cutter minimizes pipe deformation caused by a shearing cut but has been considered to be too heavy and too complex for use as a dynamic cutter in a conventional highspeed tube mill.

The foregoing detailed description is to be clearly understood as given by way of illustration and example only, the spirit and scope of this invention being limited solely by the appended claims.

What is claimed is:

1. Pipe bending apparatus comprising
a support,
a bend die rotatably mounted on said support,
means for feeding a pipe and advancing it toward said bend die, clamp die means mounted on said support for rotation with said bend die for bending pipe around said bend die, and
means for severing a portion of said pipe after it has been bent, said severing means comprising
a bolster mounted on said support for motion in a path toward and away from said bend die,
means for driving said bolster along said path,
a cutting clamp assembly movably mounted on said support and adapted to surround said pipe adjacent said bend die,
means for moving said cutting clamp assembly along said support and along said pipe to a position interposed between said bend die and said bolster,
cutter means mounted on said support for motion relative to said cutting clamp assembly and said pipe surrounded thereby, and
means for driving said cutter means to sever said pipe.

2. The pipe bending apparatus of claim 1 wherein said bend die is mounted for lateral motion to and from said pipe, and including means for driving said bend die away from said pipe to enable said clamp assembly to move to said position between said bend die and said bolster.

3. The pipe bending apparatus of claim 1 wherein said bend die has a cut away portion adapted to bear against said cutting clamp assembly when said cutting clamp assembly is in said position interposed between said bend die and said bolster.

4. Bending apparatus comprising
rotatably mounted bend and clamp dies,
a pressure member,
a slide member slidably mounted to said pressure member,
a pressure die fixed to said slide member for cooperating with said bend and clamp dies to bend a pipe around said bend die,
a shearing clamp assembly comprising
first and second mutually opposed clamp blocks each having a cavity adapted to receive said pipe to be cut,
said clamp blocks each including means for guiding a shearing cutter across said clamp block cavities,
a shearing cutter mounted for reciprocation in said guiding means and across said cavities, and
means for driving said shearing cutter across said cavities,
said shearing clamp assembly being mounted upon said slide member whereby motion of said slide member relative to said pressure member will position either said pressure die or said shearing clamp assembly adjacent said pressure member.

5. The bending apparatus of claim 4 wherein said bend die includes a flat portion forming a backup member, said slide member being movable relative to said pressure member to interpose said shearing clamp assembly between said pressure member and said flat bend die portion.

6. The apparatus of claim 4 wherein said bend die is mounted for movement toward and away from said pipe to be bent and means for driving said bend die away from said pipe to allow said shearing clamp assembly to be interposed between said bend die and pressure member.

7. Bending apparatus comprising
a support,
bend and clamp dies mounted for rotation on said support,
pressure means for pressing a portion of a pipe,
a clamp assembly slidably mounted on said support for motion to and from a position interposed between said bend die and said pressure means, and
cutter means mounted on said support for severing said pipe at said clamp assembly.

8. The apparatus of claim 7 wherein said pressure means comprises a pressure member, a slide member slidably mounted to said pressure member, a pressure die fixed to said slide member for cooperating with said bend and clamp dies to bend pipe around said bend die, said clamp assembly being mounted on said slide member for motion therewith to and from a position interposed between said bend die and said pressure member.

9. The method of bending pipe and severing it after bending comprising the steps of clamping a pipe between a rotatable bend die and clamp die, rotating the clamp and bend dies to bend the pipe around the bend die while restraining a rearward portion of the pipe, positioning a clamp assembly around the pipe adjacent the bend die, pressing the clamp assembly toward the bend die to clamp a portion of the pipe, and cutting said clamped pipe portion within said clamp assembly.

10. The method of severing a portion of a pipe after it has been bent by a pipe bending machine that has a bend die and a slide for mounting a pressure die, said method comprising the steps of laterally retracting the bend die, clamping a portion of the pipe between the slide and bend die, and severing the pipe adjacent said clamped portion.

11. The method of severing a portion of a pipe after it has been bent by a pipe bending machine having a bend die and a pressure die mounted on a movable slide, said method comprising the steps of moving the slide to a position adjacent the bend die, pressing the slide toward the bend die to clamp a portion of the pipe therebetween, and severing the pipe at the clamped portion.

12. The method of bending pipe and severing it after bending comprising the steps of bending the pipe around a bend die, positioning a clamp assembly around the pipe adjacent the bend die, pressing the clamp assembly toward the bend die to clamp a portion of the pipe therebetween, and cutting said clamped pipe portion within said clamp assembly.

* * * * *